US011708688B2

(12) United States Patent
Simon

(10) Patent No.: US 11,708,688 B2
(45) Date of Patent: Jul. 25, 2023

(54) PERSONAL PERINEAL CLEANSING SYSTEM AND METHODS

(71) Applicant: Kelley Simon, Las Vegas, NV (US)

(72) Inventor: Kelley Simon, Las Vegas, NV (US)

( * ) Notice: Subject to any disclaimer, the term of this patent is extended or adjusted under 35 U.S.C. 154(b) by 0 days.

(21) Appl. No.: 17/588,151

(22) Filed: Jan. 28, 2022

(65) Prior Publication Data

US 2022/0154442 A1 May 19, 2022

Related U.S. Application Data

(63) Continuation-in-part of application No. 16/908,028, filed on Jun. 22, 2020, now Pat. No. 11,234,562, which is a continuation-in-part of application No. 16/237,644, filed on Dec. 31, 2018, now Pat. No. 10,689,836.

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/443, 444, 445, 446, 447, 448, 420, 4/420.3
See application file for complete search history.

(56) References Cited

U.S. PATENT DOCUMENTS 2,749,558 A 6/1956 Paul et al.
3,164,846 A * 1/1965 Foster ..... A61M 3/0208 4/420.1
3,577,567 A 5/1971 Wintercorn
3,626,941 A 12/1971 Webb
3,770,200 A 11/1973 Bauer et al.
3,849,806 A 11/1974 Simpson et al.
4,432,105 A 2/1984 Pitroda
4,791,686 A 12/1988 Taniguchi et al.
5,742,961 A 4/1998 Casperson et al.
5,933,881 A 8/1999 Smith
5,951,511 A 9/1999 Lowder
5,974,601 A 11/1999 Drane et al.
5,978,983 A 11/1999 Queen et al.
6,651,267 B1 11/2003 Utz
6,785,915 B1 9/2004 Daugherty
7,047,577 B1 5/2006 Cirilli
7,774,871 B1 8/2010 Arsenault
7,913,329 B2 3/2011 Smith
8,185,982 B1 5/2012 Lizama et al.
8,281,423 B2 10/2012 Taylor et al.
8,677,520 B2 3/2014 Storm
(Continued)

*Primary Examiner* — Lori L Baker
(74) *Attorney, Agent, or Firm* — Connie R. Masters

(57) ABSTRACT

A basin bidet style personal perineal cleansing system includes a secondary toilet seat having right and left side slot openings, a handle assembly with handle stems extending through the side slot openings, hand grips disposed at the distal ends of the handle stems, and a basin support carrying a basin with an interior sprayer. The handle stems are pivotally supported within the side slot openings. The proximal ends of the two handle stems are rotatably attached to the basin support. When a user applies downward force on the hand grips, the distal ends of the handle stems move downwardly, the proximal ends of the handle stems pivot upwardly, and the basin support with the attached basin is raised to achieve a suitable fit against the user's perineal area, which is then sprayed with water from the interior sprayer.

20 Claims, 17 Drawing Sheets

(56) References Cited

U.S. PATENT DOCUMENTS

| | | | | |
|---|---|---|---|---|
| 8,904,575 | B1 | 12/2014 | Lindheimer | |
| 9,095,483 | B2 | 8/2015 | Storm | |
| 10,689,836 | B1 * | 6/2020 | Simon | A61H 1/00 |
| 11,234,562 | B1 * | 2/2022 | Simon | A47K 3/281 |
| 2002/0083516 | A1 | 7/2002 | Wing et al. | |
| 2004/0070238 | A1 | 4/2004 | Moser et al. | |
| 2004/0237188 | A1 | 12/2004 | Marcellus | |
| 2006/0247604 | A1 | 11/2006 | Bruno | |
| 2007/0032765 | A1 | 2/2007 | Honda | |
| 2009/0043267 | A1 | 2/2009 | Jackson | |
| 2010/0306912 | A1 | 12/2010 | McCabe | |
| 2017/0231866 | A1 | 8/2017 | Lenci | |
| 2018/0023276 | A1 * | 1/2018 | Puskas | A47K 10/48 4/444 |
| 2019/0368182 | A1 * | 12/2019 | Ethier | E03D 9/00 |
| 2021/0293013 | A1 * | 9/2021 | Schrant | E03D 9/08 |

* cited by examiner

PERSONAL PERINEAL CLEANSING SYSTEM AND METHODS

CROSS REFERENCE TO RELATED APPLICATIONS

This application is a continuation-in-part of U.S. patent application Ser. No. 16/908,028 filed on Jun. 22, 2020 and issued on Feb. 1, 2022 as U.S. Pat. No. 11,234,562, which is a continuation-in-part of U.S. patent application Ser. No. 16/237,644 filed on Dec. 31, 2018 and issued on Jun. 23, 2020 as U.S. Pat. No. 10,689,836, which are both incorporated herein in their entirety.

FIELD OF INVENTION

This invention relates generally to bathing devices for hygienic purposes, and, more particularly, to a personal perineal cleansing hygiene system with a basin carrying an interior water sprayer.

BACKGROUND OF THE INVENTION

A person that is handicapped, elderly, or otherwise has limited mobility may not be able to efficiently clean the perineal area, which is necessary for personal hygiene and comfort, as well as to prevent adverse skin conditions. For example, a person with limited mobility, such as a person with a severe back injury, may not be able to reach the anal area for removing feces after a bowel movement. It would be advantageous for the person with limited mobility to be able to stand upright or sit on the toilet while cleaning the perineal area, but the available cleaning devices have limitations and do not fully meet the needs of a person with limited mobility.

For example, handheld shower wands may be used to attempt to wash the perineal area, but the spray wand often has a spray that is too strong for the delicate skin of the perineal area, is typically too short, is hard to manipulate to direct the water delivery angle, and is angled incorrectly for directing the spray onto the perineal area. Additionally, washing feces onto the bottom surface of the shower or tub may not only be distasteful and unsanitary, but the person with limited mobility is not likely to be able to reach to the bottom surface of the shower or tub to clean and remove any residual waste.

Some conventional perineal cleansing systems are designed for hospital use by a caregiver but are too complex and expensive for personal use.

Bidets have also been used to attempt to address this problem. Often bidets are a standalone bowl structure (similar to a standalone toilet) that is placed near the toilet, but this necessitates sufficient floor space to be available. Often separate bidets can only be installed at the time of the construction of the house because space may not be obtainable in a pre-existing bathroom layout. Additionally, if a standalone bidet is to be added to an existing bathroom, major plumbing and structural alterations are often needed. Some bidets are available that are attachable to a toilet. These comprise sprayers that are directed to the general area of the body, but they typically do not adequately cleanse, and they often cause overspray.

Accordingly, a personal perineal cleansing device is needed that is specifically designed to clean the delicate skin of the perineal area, and that, when used in a shower or bathtub or as an addition to a toilet, provides improved cleansing of the perineal area, that does not require major plumbing alternations during installation, that does not use additional floor space, and that does not require any construction work to install.

BRIEF SUMMARY OF THE INVENTION

The present invention is directed to a personal perineal cleansing hygiene system and methods of assembly and use that allows a person to clean the perineal area. This system is usable by all, but it may provide particular advantages to a person with limited mobility.

Five embodiments are presented. In the first embodiment, the personal perineal cleansing system is a handheld device added onto a shower. In the second embodiment, it is a handheld device added to a bathtub installation (using either the bathtub floor drain or the bathtub overflow drain). In the third embodiment, the handheld device is usable with a modified toilet. In the fourth embodiment, the handheld device is portable and is usable for camping or long-haul trucking. In the fifth embodiment, the device is not handheld, but is instead a basin bidet incorporated into a secondary toilet seat that is installed as an add-on to an existing toilet.

The water input for the personal perineal cleansing system of the first to third and the fifth embodiment comes from existing piping or fixtures in the bathroom. Thus, it is easily installed and does not require major plumbing changes or extensive modifications to a bathroom. The fourth embodiment is self-contained, so the water for the fourth embodiment comes from an integrated water tank.

In contrast to a free-standing bidet, the personal perineal cleansing system does not require any additional floor space be allocated to it.

In an aspect of the first four embodiments of the invention, the personal perineal cleansing system includes a three-connection handle with connections to the spray arm at the top, middle and bottom of the handle.

In an additional aspect of the first four embodiments of the invention, the personal perineal cleansing system includes a two-connection handle with connections to the spray arm only at the top and bottom of the handle.

In a further aspect of the first four embodiments of the invention, the handle of the personal perineal cleansing system comprises a two-grip design that is easily grasped by two hands.

In a further aspect of the first four embodiments, the personal perineal cleansing system includes a handle interior reservoir, a handle input port that allows introduction of a fluid into the interior reservoir, and a handle shut-off valve that, when open, allows the fluid from the interior reservoir to enter the fluid flow passage of the spray arm.

In an additional aspect of the invention, the personal perineal cleansing system includes a buttocks spreader system.

In a further aspect of the invention, the personal perineal cleansing system includes a lid to cover the accumulation basin.

In an additional aspect of the first three embodiments, the personal perineal cleansing system includes a two-part drain fitting having an interior portion connected to the removal line and an outer portion with holes allowing drainage of water into the plumbing drainpipe.

In an aspect of the second embodiment of the invention, the personal perineal cleansing system is configured for installation in a combination shower/bathtub using the overflow drain.

In an additional aspect of the second embodiment of the invention, the personal perineal cleansing system is configured for installation in a combination shower/bathtub using the floor drain.

In an aspect of the third embodiment of the invention, the personal perineal cleansing system is configured for use while seated on a modified toilet.

In another aspect of the third embodiment of the invention, the handheld personal cleansing system includes a specialized toilet riser to provide vertical height to accommodate the use of the handheld personal cleansing system.

In an aspect of the fourth embodiment of the invention, the personal perineal cleansing system is self-contained and portable.

In the fifth embodiment of the invention, the personal perineal cleansing system is incorporated into a secondary toilet seat.

In another aspect of the fifth embodiment of the invention, the primary toilet seat and the secondary toilet seat are separately rotatable between a horizontal and a vertical orientation.

In a further aspect of the fifth embodiment of the invention, the secondary toilet seat and the primary toilet seat are integrated into a primary-secondary seat unit.

In an additional aspect of the invention, the personal perineal cleansing system includes wall mounted holder that provides a location to store the cleaning system when not in use.

In another aspect of the invention, the personal perineal cleansing system includes a spray head with a separator shield.

In a further aspect of the invention, the personal perineal cleansing system has an internal sprayer with nozzles directed upwardly for perineal cleansing and outwardly to rinse the interior of the sprayer.

In another aspect of the invention, the personal perineal cleansing system has an internal sprayer with nozzles directed upwardly only.

In an additional aspect of the invention, the personal perineal cleansing system includes a sprayer with a single nozzle type.

In another aspect of the invention, the personal perineal cleansing system includes a sprayer with multiple nozzle types.

The object of the invention is to provide a personal perineal cleansing system which gives an improved performance over the above-described prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a personal hygiene perineal cleansing system that allows a user to clean his/her perineal area while the system captures waste and/or debris and residual water within a basin incorporated into the cleansing system. In four embodiments (the first, second, third, and fifth embodiments) of the invention, water is introduced into the personal hygiene perineal cleansing system by adding a fitting to a fixture or waterpipe of the bathroom, so it is easy to install and requires no modifications to the installed plumbing. In these four embodiments, the personal hygiene perineal cleansing system may be installed for use in a shower, bathtub, combination shower/bathtub, or toilet.

Figure 1:
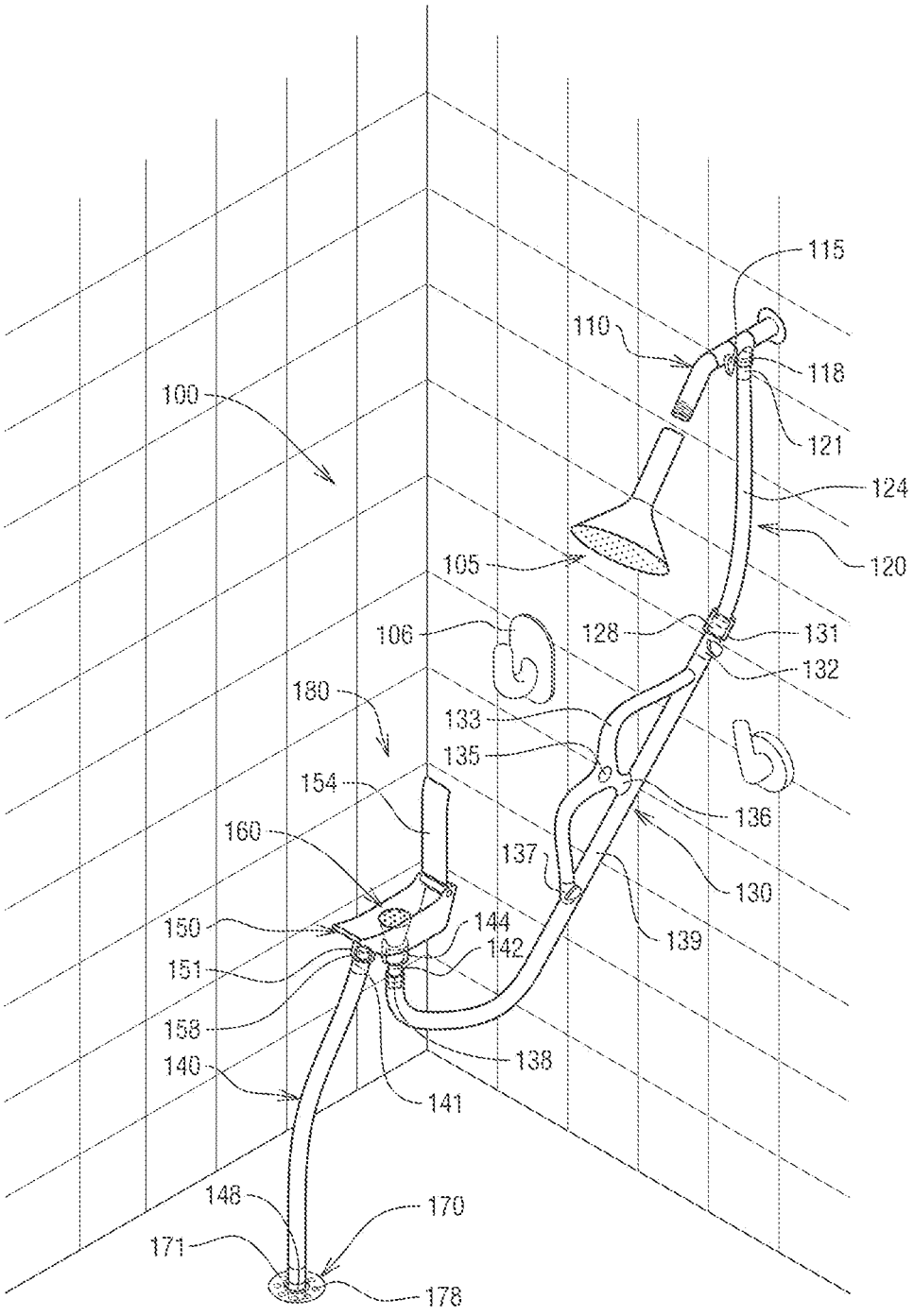
FIG. 1 is a perspective view of a first embodiment of the present invention in an exemplary environment of use, as installed in a shower stall.
Figure 2:
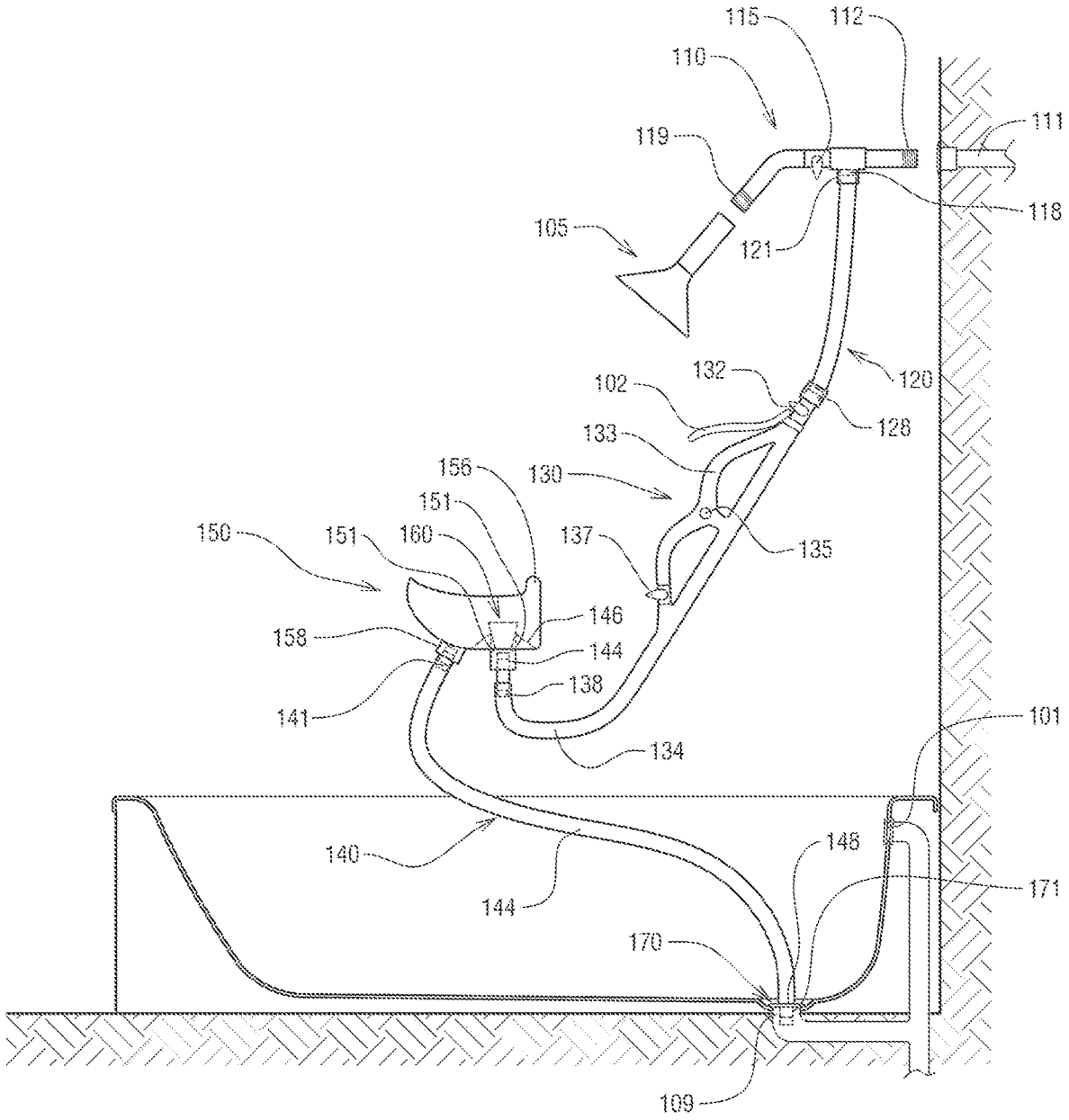
FIG. 2 is a side, partial cut-away view of a second embodiment of the present invention in an exemplary environment of use, utilizing the bathtub floor drain, with the bathtub and wall cut away to show the house plumbing.
Figure 3:
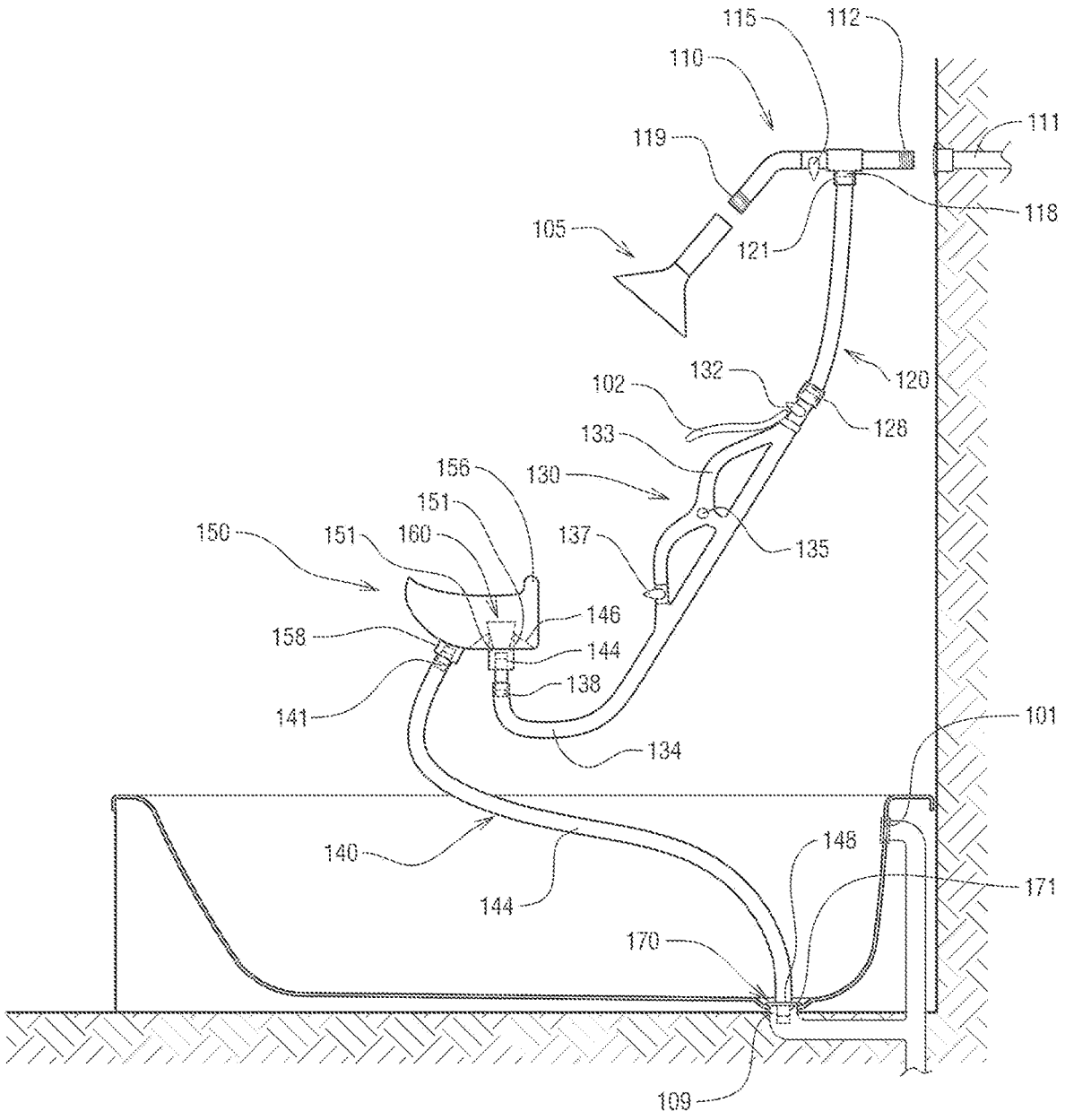
FIG. 3 is a side, partial cut-away view of the second embodiment of the present invention in an exemplary environment of use, utilizing the bathtub overflow drain, with the bathtub and wall cut away to show the house plumbing.
Figure 10:
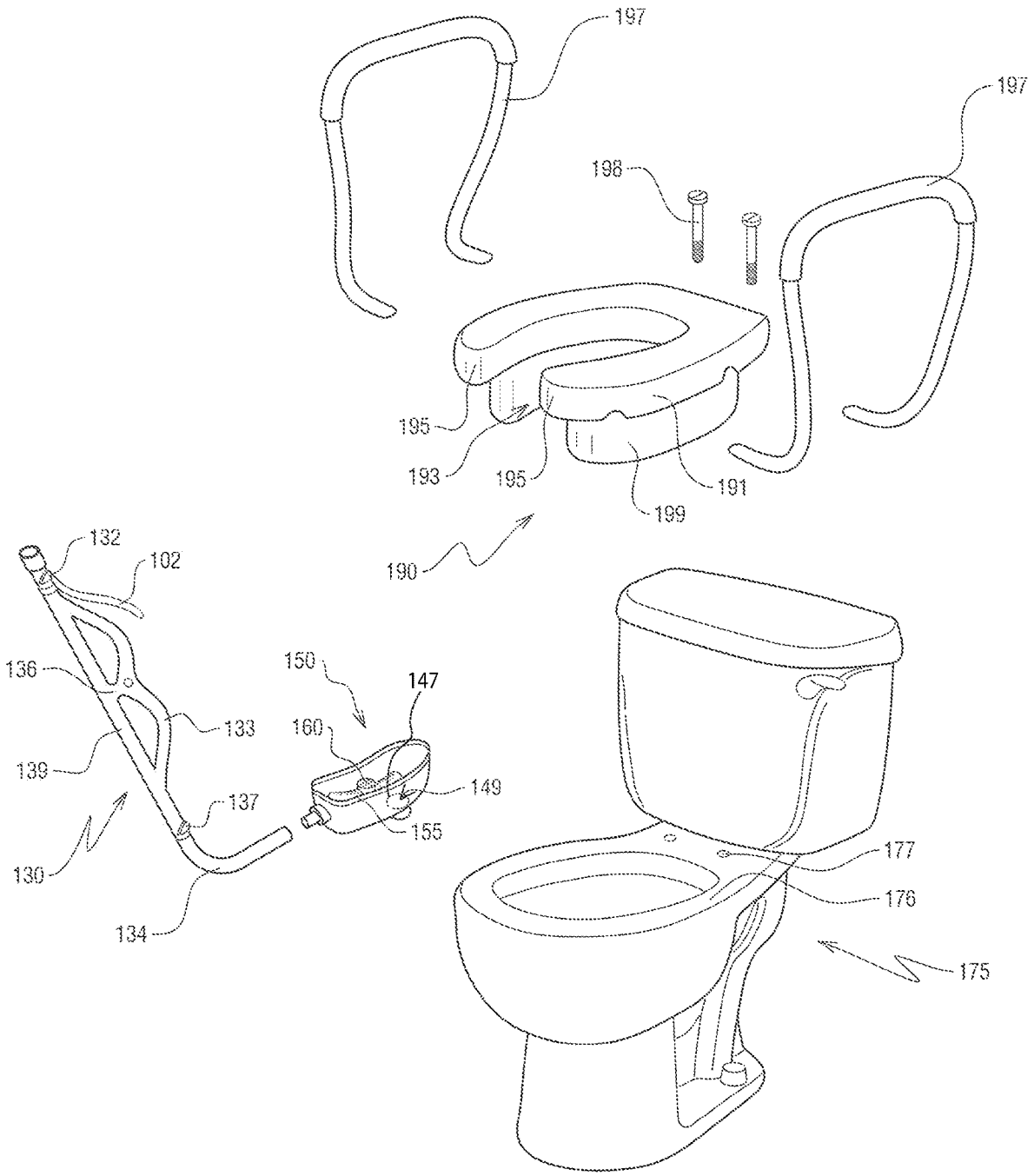
FIG. 10 is an expanded perspective view of a fourth embodiment of the present invention in an exemplary environment of use, for use with a specialized riser and toilet.
Figure 11:
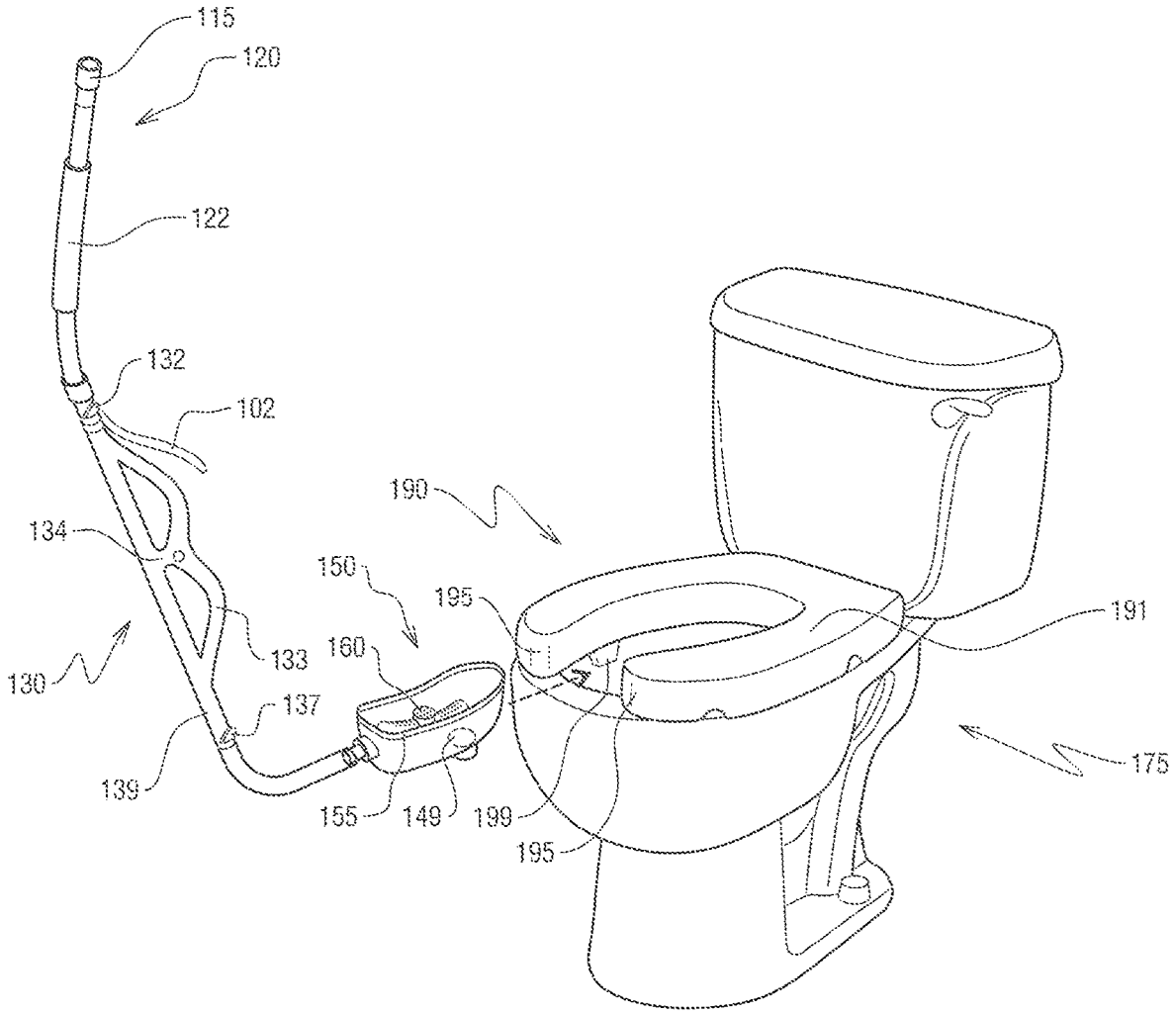
FIG. 11 is a perspective view of a fourth embodiment of the present invention in an exemplary environment of use, as used with a specialized riser and a toilet.

In a first embodiment the personal hygiene perineal cleansing system is handheld and is installed in a shower using the shower floor drainpipe for drainage (FIG. 1). In a second embodiment it is handheld and is installed in a combination shower/bathtub using the bathtub floor drainpipe for drainage (FIG. 2) or is installed in a combination shower/bathtub using the bathtub overflow drainpipe for drainage (FIG. 3). In a third embodiment, the cleansing device is handheld, is installed near a toilet, and uses the toilet for drainage (FIGS. 10-11). In a fourth embodiment (FIGS. 12-13), the handheld device is portable, is self-contained (not connected to a household water line), and is usable for camping or long-haul trucking. In a fifth embodiment (FIGS. 17-22), the cleansing device is not handheld, but is instead installed as an add-on bidet basin to an existing toilet through its integration into a secondary toilet seat.

In the embodiments in which the personal perineal cleansing system is installed in a shower or bathtub, the water intake may be a fitting introduced between the existing shower water supply pipe and the existing plumbing drainpipes. In the third embodiment the water intake may be a fitting positioned within the toilet water lines, within water lines supplying a sink, or within the existing shower water supply pipe. The water for the fourth embodiment is supplied by an incorporated water tank. The water intake for the fifth embodiment is preferably the household water line supplying water to the toilet.

Referring now to FIG. 1, a handheld personal hygiene perineal cleansing system, shown generally as reference number 100, is illustrated in accordance with a first embodiment of the present invention. As shown, the handheld personal hygiene perineal cleansing system 100 comprises a water-ingress fitting 110 that connects to and receives a fluid flow from a building's fluid flow pipe 111 (FIG. 2); a water-ingress valve to control the fluid flow into the water-ingress fitting 110; a flexible feeder supply line 120 that connects to and receives a fluid flow from the water-ingress fitting 110; an elongated spray arm 130 that connects to and receives a fluid flow from the feeder supply line 120 and that incorporates an integrated handle 133; an accumulation basin 150 that includes a basin outlet drain 158; a sprayer 160 disposed within the accumulation basin 150 that is fluidly connected to and receives a fluid flow from the spray arm 130; a removal line 140 that connects to and receives a fluid flow from the basin outlet drain 158, and a drain fitting 170 that replaces the existing drain pipe cover and that is configured to allow attachment of the distal end of the removal line 140 while simultaneously allowing water within the shower or bathtub to drain into the building's drain pipes and eventually to the sewer lines.

One or multiples ones of the water-ingress fitting 110, flexible feeder supply line 120, spray arm 130, and handle 133 may include a plumbing valve. The water-ingress fitting 110 preferably comprises a tee fitting that includes a water-ingress valve 115 that can be shut to prevent fluid from flowing to the showerhead 105 and to thereby allow the water to enter the handheld personal hygiene perineal cleansing system 100. The feeder supply line 120 or the spray arm 130 preferably include a valve 132 to shutoff or turn on the fluid flowing from the water-ingress fitting 110 to the sprayer 160. The handle 133 may optionally have a handle valve 137 to allow secondary fluid that has been introduced into a handle interior reservoir via the handle fill port 135 to flow into the main fluid flow passage of the spray arm 130. These plumbing valves 115, 132, 137 comprise shut-off valves (also known as stop valves or isolating valves), which include gate valves, globe valves, ball valves, or other similar shut-off type valves, but a ball valve type shut-off valve is preferred. The valves may include configurations such as two-port, 3-port, two-stop/one manifold, and the like. In an aspect, the valve 115 may be a two-stop valve on one manifold configuration, and the second shut-off valve 132 would not be necessary. In yet a further aspect, the valve 115 may be a 3-port valve in which the fluid flow from the ingress port 112 may be switched to the first outlet 119 or to the second outlet 118, which also eliminates the need for the second shut-off valve 132.

In a conventional bathroom, a shower or a shower/bath combination has an existing showerhead 105 configured with showerhead nozzles that provide a spray of water into the shower surround or the shower/bath combo surround. Additionally, the existing showerhead 105 has an internal water flow passage and is configured to be attached to, and receive a fluid flow from, the building's fluid flow pipe in, which in turn has an internal water flow passage and is configured to be attached to and receive a fluid flow typically from a municipal pressurized water supply pipe.

In the first embodiment, the water-ingress fitting 110 of the handheld personal hygiene perineal cleansing system 100 is interposed between the existing fluid flow pipe 111 (FIG. 2) and the showerhead 105. The water-ingress fitting 110 comprises a tee fitting with a tee inlet 112, a first tee outlet 119, a second tee outlet 118, a tee valve-type water-ingress fitting 115, and at least one internal fluid flow passage. The tee inlet 112 is configured to connect via mating connectors to, and to receive a fluid flow from, the fluid flow pipe 111. The first tee outlet 119 is configured to connect via mating connectors to, and to convey a fluid flow to, the showerhead 105 when the tee valve 115 is open. The second tee outlet 118 is configured to connect via mating connectors to, and to convey a fluid flow to, the flexible feeder supply line 120. The mating connectors of this connection and the other connections of the system 100 are standard plumbing mating connectors, such as corresponding male-female threaded portions or corresponding portions of a quick release connector. In one aspect of the invention, the fluid flow pipe 111 has female threads and the tee ingress port 112 is configured with mating male threads; the first tee outlet 119 has male threads and the showerhead 105 has mating female threads; and the second tee outlet 118 and flexible feeder supply line 120 have mating male and female threads. In a further aspect of the invention, the mating connectors may be permanently and fixedly connected. In another preferred aspect of the invention, the mating connectors connecting the second tee outlet 118 and the feeder supply line 120 comprise mating portions of a quick release connector.

The flexible feeder supply line 120 comprises at least one internal fluid flow passage, a feeder supply line inlet 121, a flexible tubing 124, and a feeder supply line outlet 128. The flexible tubing 124 comprises a water supply line suitable for hot and cold water that extends from the feeder supply line inlet 121 to the feeder supply line outlet 128. Preferably the flexible tubing comprises a bendable braided line. Braided line types include braided nylon flex tubes made from reinforced braided nylon with a solid polyvinyl chloride (PVC) inner core, stainless steel flex tubes made of braided stainless steel surrounding an inner tube of PVC or nylon, PVC flex tubes made of a PVC outer core that is usually braided with nylon and an inner core made of solid PVC, polymer-coated flex tubes with outer polymer-coated fibers and an inner PVC core, and the like.

The feeder supply line outlet 128 is configured to connect to, and to convey a fluid flow to, the spray arm 130. The feeder supply line outlet 128 and the spray arm inlet 131 have mating connectors, similar to the feeder supply line inlet 121 and the second tee outlet 118 mating connectors, as described above.

The elongated spray arm 130 comprises at least one internal fluid flow passage, a spray arm inlet 131, a spray arm outlet 138, an elongated casing body 139, an at least one handle 133, and, optionally, a spray arm shut-off valve 132. The spray arm inlet 131 is configured for connecting to the feeder supply line outlet 128 via mating connectors and for receiving a fluid flow from the feeder supply line outlet 128. The elongated casing body 139 is rigid and non-flexible. It comprises an upper generally straight portion that carries the handle 133 and a lower curved or arc-shaped portion 134 (FIG. 2) that has an arc that is complementary to the shape of a human body with a portion mimicking the human body shape from the pubic bone to the coccyx bone, which allows the user to correctly position the accumulation basin 150 carrying the sprayer 160. The casing body 139 receives a fluid flow from the spray arm inlet 131 and conveys fluid to the spray arm outlet 138. The spray arm outlet 138 is configured for conveying (either indirectly through a portion of the basin 150 or directly) a fluid flow to, the inlet port 161 (FIG. 4) of the sprayer 160 disposed within the accumulation basin 150. At least one of the spray arm outlet 138 or the interiorly-disposed sprayer 160 is configured for connecting to the accumulation basin 150 in a substantially water-tight connection. In an embodiment of the invention, the spray arm outlet 138 connects to a basin extension 142 fixedly attached to the basin 150 and the basin extension 142 directs the fluid flow to a quick release connector 144 to which the sprayer 160 is connectable. By usage of the quick release connector 144, it is easy to remove, clean, and replace the sprayer 160. In another aspect, the spray arm outlet 138 connects directly to the sprayer 160, preferably with a quick release connector, and the basin 150 attaches to the sprayer 160.

The handle 133 of the spray arm 130 allows the user to position the accumulation basin 150 for maximum comfort and collection and to direct the fluid spray from the spray head 169 for maximal cleansing. In the aspect shown in FIG. 1, the handle 133 has an upper end that is fixedly attached at an upper portion of the spray arm 130 and a lower end that is fixedly attached at a middle or mid-lower portion of the spray arm 130. In this aspect of the invention, the handle 133 comprises a two-loop or two-grip handle with two outwardly curved loops and an inwardly curved middle section or waist 136. In the aspect shown in FIG. 1, the inwardly curved middle section 136 is also fixedly attached to the spray arm 130. The dual grips allow the user to have optimum control of the positioning of the sprayer 160 and accumulation basin 150. In some aspects, shown in FIGS. 1, 2, 4, 9, 10, the inwardly curved middle section 136 is attached to the spray arm 130. Attachment of the middle section 136 to the spray arm 130 enhances the robustness of the structure. However, in another aspect shown in FIG. 3, the inwardly curved handle middle section 136 is unattached to the spray arm 130, and the handle is only attached at the upper end and at the lower end. In both of these aspects, the inwardly curved middle section 136 disposed between the two outwardly curved loops guide the user in an advantageous positioning of the hands of the user and/or to encourage gripping of the loops.

In one aspect of the invention, the handle 133 includes an internal fluid storage passageway and/or reservoir, a fill port 135 preferably covered with a cap, and a fluid exit port. The handle's internal fluid storage reservoir is an interior cavity within the handle into which a secondary fluid is introduced through the handle fill port 135 and out of which the secondary fluid exits through a handle exit port. The fluid flow from the handle exit port is manually controlled by a handle shut-off valve 137 that retains the secondary fluid introduced into the fill port 135 in the storage reservoir or allows the secondary fluid in the storage passageway to flow into the lower portion of the spray arm 130. The fill port 135 allows the introduction of cleaners or disinfectants into the internal fluid storage passageway/reservoir for cleaning the accumulation basin 150, the sprayer 160, and the removal line 140. In another aspect medicaments, treatments, balms, and oils can be introduced into the fluid being sprayed onto the perineal area by the sprayer 160 via use of the fill port 135 and manual opening of the valve 137. Thus, the secondary fluid may comprise cleaners or health and beauty aids.

In another aspect of the invention, a safety lever 102 (FIGS. 2, 4) is installed that activates the shut-off valve 132 or a separate shut-off valve near the top of the spray arm 130. In the relaxed position, the valve is closed and no fluid flows into the spray arm 130. In the depressed position, the valve is open and fluid flows into the spray arm 130 and on to the sprayer 160. The inclusion of the lever 102 is a safety feature that provides the user with another layer of control. The lever 102 regulates the volume of fluid flow and so may also be used to maximize or minimize the fluid flow, thereby providing the user with volume enhanced control and additional comfort.

The sprayer 160 is disposed within the accumulation basin 150. The sprayer 160 comprises at least one internal fluid flow passage, an inlet port 161, and a spray head 169 having a nozzle matrix or assembly 168. The sprayer 160 is configured for receiving fluid flow from, the spray arm 130. The sprayer 160 may be directly connected to the spray arm outlet 138 via mating connectors or otherwise connected to receive the fluid flow. In the preferred aspect, the basin 150 includes a tubing extension 142 (FIG. 4) configured with a quick release connector. The extension 142 is fixedly attached to or formed integrally with the basin 150. A basin quick release connector 144 is mated to the sprayer quick release connector at sprayer inlet 161, which may be mounted on a stem 162. The fluid flows from the sprayer inlet 161 through any stem 162 into the body of the sprayer 160 and into the spray head 169 and out a nozzle 168A, 168B of the nozzle assembly or nozzle matrix 168.

The spray head 169 comprises the nozzle assembly 168, which is configured to spray a fluid flow that sprays onto and washes the perineal area. The residual fluid, carrying any dirt, bacteria, or feces that has been washed away from the perineal area, is accumulated in the accumulation basin 150. This residual fluid is received by the accumulation basin 150, flows through the basin outlet drain 158 and into the inlet 141 of the removal line 140 and on to the drain fitting 170.

In a preferred aspect of the invention, the nozzle assembly 168 of the spray head 169 comprises multiple nozzles 168A (FIG. 4) that are directed upwardly to cleanse the perineal area and additionally comprises one or more nozzles 168B that are directly outwardly and/or downwardly to wash the interior surface of the accumulation basin 150. In one aspect the nozzles 168A, 168B may all disperse similar amounts of water at similar pressure. In another aspect, some of the nozzles 168A, 168B may vary from others of the nozzles 168A, 168B in spray strength. In a further aspect, some or all the nozzles 168A, 168B may provide a pulsating spray.

In one aspect of the invention, the spray head 169 may also optionally comprise a divider shield 167 (FIG. 4) that may be manually positioned by the user for additional comfort and affords the ability to protect delicate areas from an uncomfortably strong spray. The nozzles on the forward portion of the spray head 169 may be configured to spray with a lighter force than the nozzles on the rearward portion of the spray head 169. This aspect which may provide advantages to female users, who may position the divider shield 167 between the anus and the labia to provide a softer spray to the labial area and a more vigorous spray to the anal area. Usage of the divider shield 167 may also provide separation to solve actual or perceived hygiene issues.

Figure 4:
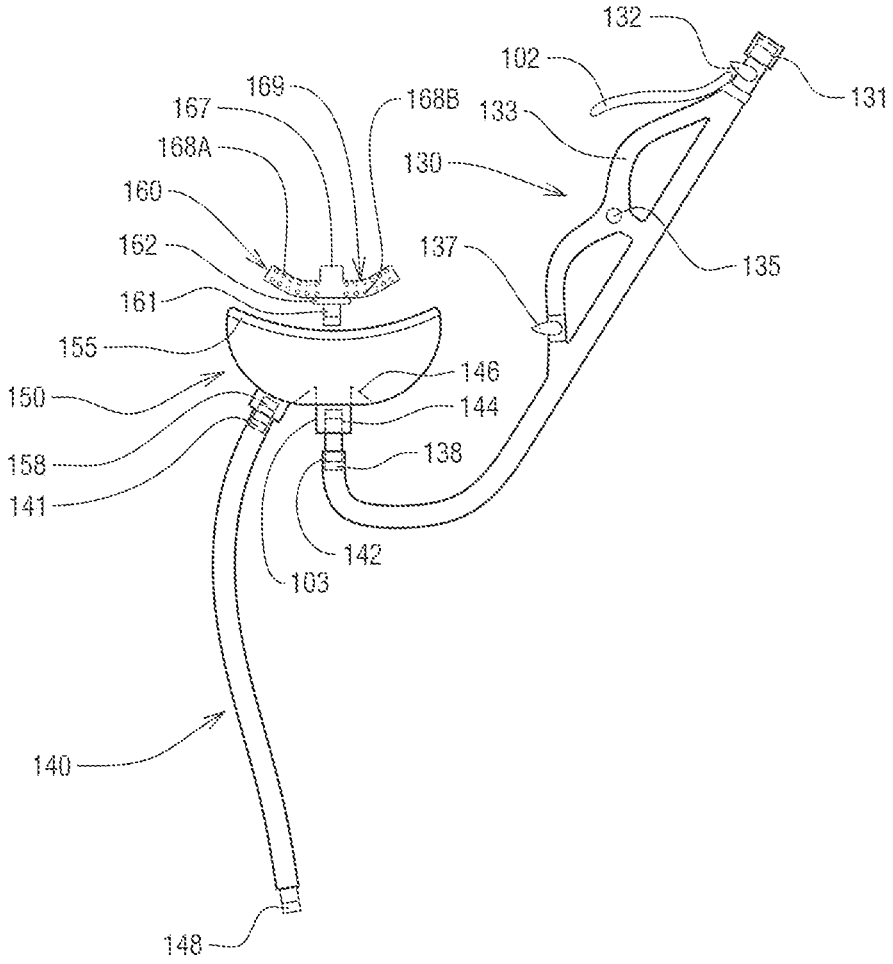
FIG. 4 is a side, partially expanded view of the accumulation basin, spray head, supply line, and water removal line of one embodiment of the present invention.
Figure 5:
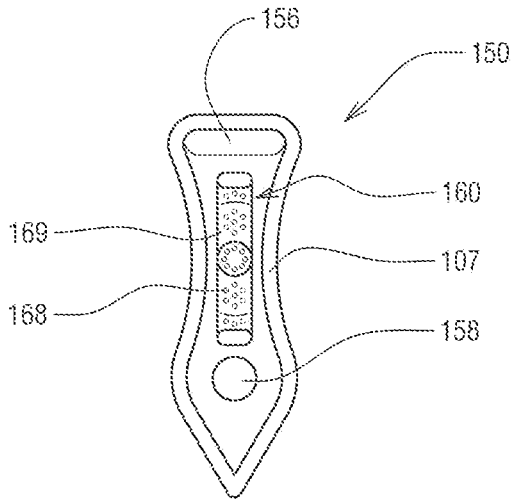
FIG. 5 is a top view of the accumulation basin and basin spray head of an embodiment of the present invention.
Figure 6:
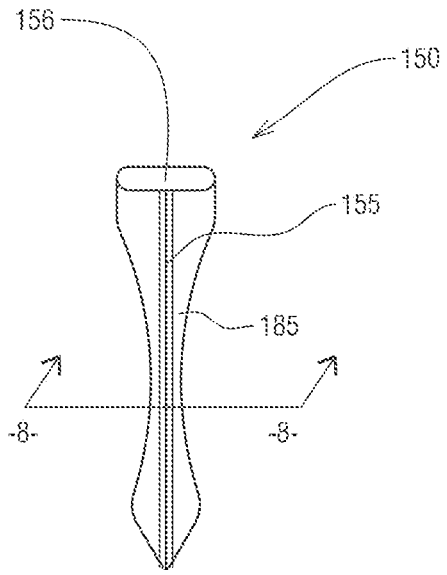
FIG. 6 is a top view of the expandable accumulation basin of another embodiment of the present invention in the relaxed, unexpanded state.
Figure 7:
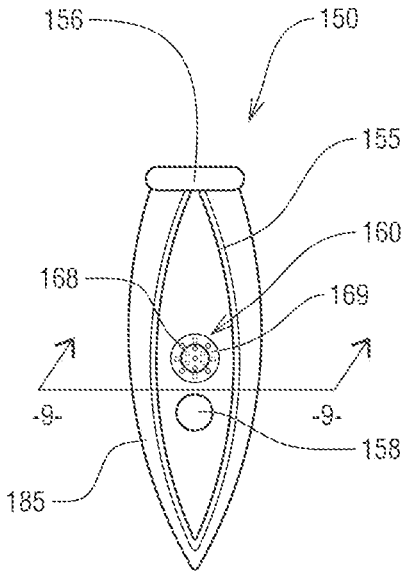
FIG. 7 is a top view of the expandable accumulation basin and basin spray head of FIG. 6 in the expanded or open state.
Figure 8:
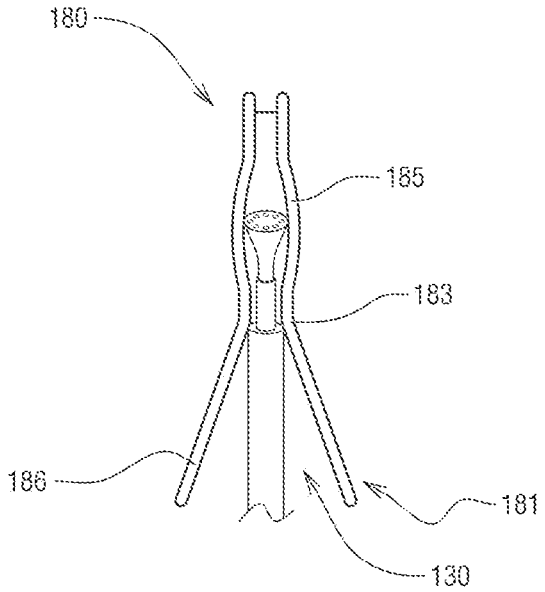
FIG. 8 is a side view of the buttocks spreader system of the expandable accumulation basin of FIG. 6.
Figure 9:
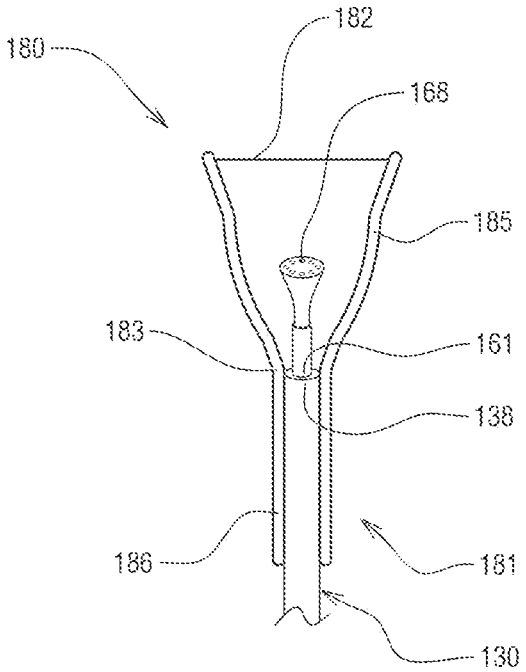
FIG. 9 is a side view of the buttocks spreader system of the expandable accumulation basin of FIG. 7.

The spray head 169 may be elongated as seen in FIGS. 3-5 or may be circular as seen in FIGS. 1-2, 7-9, 20. In one aspect of the invention, multiple spray heads (or compound spray heads) may be included. In this aspect, each of the multiple spray heads 169 may be directed in the same or different directions, may have the same or different spray strengths, and may have the same or different spray patterns.

The accumulation basin 150 is a round or oblong concave open top, bowl-shaped vessel that is sized and configured to accommodate the sprayer 160 disposed internally of the basin 150. Preferably, the basin 150 is an oblong, concave, one-piece molded plastic container. The accumulation basin 150 comprises an inner surface, an outer surface, a rim 155 encircling the upper edge, and two openings, an input opening 151 and a basin outlet 158 (FIGS. 2, 4). The basin outlet 158 is configured to allow residual wash fluid to drain into the removal line 140 (or in the third, fourth, or fifth embodiments to drain into a toilet bowl. The input opening 151 is associated with facilitating the fluid flow from the spray arm 130 to the sprayer 160 in one of the aspects described above. The input opening may be in the bottom portion of the basin 150 or in the side of the basin 150 (FIG. 3).

The inner surface of the basin 150 is smooth to facilitate removal of the residual fluid and for cleaning. Particularly in the aspect in which the input opening is at the bottom of the basin, the inner surface of the basin 150 near the input opening 151 may have a raised portion 146 (FIG. 4) that minimizes backflow into the spray arm 130. The raised portion 146 encircling the input opening 151 may be formed as a mound or angled shape with a center depression into which the sprayer inlet 161 is connected.

In some aspects of the invention, the accumulation basin 150 may comprise a lid 154 that is sized and configured to fit onto or over the rim 155. In one aspect, the lid 154 is a separate element that may be snapped onto the rim. In another aspect, the lid 154 is hingedly attached to the accumulation basin 150, as seen in FIG. 1. In a further aspect, the lid 154 may have a recessed center portion. Filling the basin 150 and placing the lid 154 with the recessed center portion onto the accumulation basin 150 will force the water in the basin 150 out of the basin 150 and over the upper rim 155. This serves to rinse the outer surfaces of the basin 150.

In one aspect, the accumulation basin 150 is connected (either directly connected or connected via a portion of the sprayer 160) to the spray arm 130. This aspect facilitates easy removal of the basin 150 from the spray arm 130 for cleaning or replacement with a separate basin 150, such as may provide advantages when two members of the same household use a single personal perineal cleansing system. In another aspect, the accumulation basin 150 may be integrally formed with the spray arm 130 forming a one-piece spray arm and basin combination element. This aspect has less connections, and, thus, may provide a more robust solution. In the fifth embodiment of the basin bidet, the basin is supported by a basin support 320 pivotally connected to a handle assembly 310.

For comfort, in an aspect of the invention, the rim 155 of the basin 150 is covered with closed cell foam, rubber or rubber-like material, memory foam, memory foam covered in a pliant encasement for easy cleaning, or other soft material 107 (FIG. 5). Inclusion of a soft pliable material on the top rim 155 may facilitate a better fit against the body.

The flexible removal supply line 140 comprises at least one internal fluid flow passage, a removal line inlet 141 configured for connecting to (via mating connectors) and receiving a fluid flow from the basin outlet 158, a flexible line 144, and a removal line outlet 148. The flexible line 144 is preferably a braided water line as described above having a diameter as large as or larger than the diameter of the feeder supply line 120. The removal supply line 140 extends from the basin outlet 158 to the drain inlet 171. The removal line outlet 148 connects to and conveys a fluid flow (the residual wash fluid and any waste) to a drain inlet 171 of the drain fitting 170 within the bottom of the shower or the bathtub or within the overflow drain of the shower/bathtub combination.

The drain fitting 170 comprises at least one internal fluid flow passage, comprises the drain inlet 171 configured for connecting to (via mating connectors) and receiving a fluid flow from the removal line outlet 148, and comprises an external cover 178. The external cover 178 supports the drain inlet 171. The external cover 178 includes one or more external drain holes providing access to the internal fluid flow passage. In the aspect in which the drain fitting is installed within the floor of the shower or bathtub, multiple external drain holes are provided. The external drain holes allow the shower spray water or bath water to drain into the internal fluid flow passage of the drainpipes, while the drain inlet 171 receives the residual water collected by the accumulation basin 150 (and transported by the removal line outlet 148) and directs the residual water through the external cover 178 to drain into existing plumbing drainpipes.

For convenience of attaching, using, and disconnecting all or parts of the personal perineal cleansing system 100, preferably one or more or all of the mating inlet/outlet combinations are quick release connectors. For example, if the feeder supply line inlet 121 and the second tee outlet 118 comprise a first mating quick release connector and if the drain inlet 171 and the removal line outlet 148 comprise a second mating quick release connector, the elements of the personal perineal cleansing system 100 between the water-ingress fitting 110 and the drain fitting 170 may be removed by merely activating the first and second quick release connectors. In another aspect, the sprayer 160 and the spray arm outlet 138 comprise mating parts of a quick release connector, which allows the sprayer 160 to be removed for easy cleaning of the sprayer 160 elements and of the interior of the accumulation basin 150.

FIG. 1 shows the first embodiment in which the handheld personal hygiene perineal cleansing system 100 is installed in a shower stall. An optional hook 106 is installed on the wall of the shower surround to enable the user to place most of the handheld personal hygiene perineal cleansing system 100 onto the hook 106 when not actively being used during a shower or for storage after completion of the shower. For example, if a quick release connector is installed at the connection between the second tee outlet 118 and the feeder supply line inlet 121 and another quick release connector is installed at the connection between the removal line outlet 148 and the drain inlet 171, all of the handheld personal hygiene perineal cleansing system 100 except for the water-ingress fitting 110 may be removed from the center of the shower and stored out of the way on the hook 106.

FIG. 2 shows the second embodiment in which the handheld personal hygiene perineal cleansing system 100 is installed in a bathtub/shower combination. The drain fitting 170 is installed into the existing bathtub drainpipe 109 by removal and replacement of the existing drainpipe cover. FIG. 2 also illustrates an aspect in which an upwardly-extending ridge 156 extends along the front edge of the accumulation basin 150. This safeguard ridge 156 allows a user to place the accumulation basin 150 safely and securely at the desired location toward the front of the perineal area, so that the handheld personal hygiene perineal cleansing system 100 is steadily positioned.

FIG. 3 shows the handheld personal hygiene perineal cleansing system 100 installed in a bathtub/shower combination, but in this aspect, the drain fitting 170 is installed into the existing overflow drain 101 of the bathtub by removal and replacement of the existing overflow cover. The existing overflow cover is replaced by the drain fitting 170 having a drain inlet 171 to which a removal line outlet 148 may be attached and having an external drain cover 178 configured with one or more external holes through which any bath water may overflow into the building's drain lines.

FIG. 3 additionally illustrates a handle variation in which a rigid handle is attached to the spray arm 130 only at the top and bottom of the handle. In the embodiment of FIG. 3, the inwardly curved middle section 136 of the handle 133 does not attach to the spray arm 130, the handle does not include a handle fill port 135 and a handle valve 137, and the spray arm 130 does not include lever 102 to activate the safety valve 132.

In the embodiment shown in FIG. 3, the accumulation basin 150 and the spray arm 130 are formed as a single, unitary element with no removable connection between the spray arm outlet 138 and the basin inlet 151.

FIG. 4 provides an expanded view showing the lower portion of the sprayer 160 from the spray arm inlet 131 to the removal line outlet 148. In this embodiment both the accumulation basin 150 and the sprayer 160 are connected by quick release connectors for easy removal of one or both for washing. In one aspect a first quick release connector 144 is fixedly attached to the interior of the lower portion 103 of the basin 150. The sprayer inlet 161 is configured as a mating second quick release connector and attaches to the basin quick release connector 144.

In one aspect, a projection or raised portion 146 extends above the bottom of the basin with the basin quick release connector 144 disposed within the raised portion 146. This functions to prevent waste from inadvertently being introduced into the spray arm system 130.

In FIG. 4, an extension 142 from the basin 150 is configured with a quick release connector, which is configured to attach to a mating quick release connector (spray arm outlet 138).

FIG. 5 illustrates a top view of the sprayer 160 within the accumulation basin 150. The front of the accumulation basin 150 is configured with an upwardly-extending ridge 156 for safety and stability. In the aspect shown, the upper edges or rim 155 of the accumulation basin 150 and the ridge 156 are covered in a soft material 107, as described above. In an aspect, seen in FIG. 5, the basin 150 may be molded unitarily from plastic resin.

FIG. 5 also illustrates the aspect in which the sprayer 160 is elongated and has multiple types of nozzles 168A, 168B (or a nozzle assembly/matrix 168 formed of multiple nozzles 168A, 168B) that are directed in one or more directions. For example, some nozzles may provide a pulsing spray, and some may provide a steady spray, and some nozzles may direct their spray upwardly for cleansing the perineal area and some may direct theirs outwardly for cleaning the basin 150.

In an exemplary installation, the handheld personal hygiene perineal cleansing system 100 of the present invention may be installed by first removing the existing showerhead 105 from the building's fluid flow pipe 111, typically by unscrewing the showerhead 105. Teflon tape is preferably placed on the threads of the ingress port 112 and the first tee outlet 119. The ingress port 112 is screwed onto the existing fluid flow pipe 111, and the showerhead 105 is screwed onto the first tee outlet 119. In the aspect in which a quick release connection is installed at the junction of the second tee outlet 118 and the feeder supply line inlet 121, the feeder supply line inlet 121 is attached via the quick release connection to the second tee outlet 118. Preferably, when purchased, the spray arm 130 is pre-connected to the feeder supply line 120, the accumulation basin 150 and sprayer 160 are pre-connected to the spray arm 130, and the removal line 140 is pre-connected to the basin outlet drain 158. If these connections are not pre-connected, these elements are connected during installation.

The existing drain cover is then removed and the inventive drain fitting 170 is installed with a drain inlet 171 quick release connector preferably disposed in the center of the external drain cover 178. The quick release connector of the removal line outlet 148 is then connected to the quick release connector of the drain inlet 171 to complete the assembly. Optionally, a wall hook may be installed for hanging at least a portion of the handheld personal hygiene perineal cleansing system 100 on a wall for storage.

In the shower installation embodiments, to use the handheld personal hygiene perineal cleansing system 100 of the present invention the water-ingress valve 115 is turned to prevent the fluid from entering the showerhead 105 and to direct the fluid into the feeder supply line 120. The spray arm valve 132 is opened to allow the fluid to enter the spray arm inlet 131. The fluid travels through the water-ingress fitting 110, through the feeder supply line 120, through the spray arm 130 and out of the sprayer 160 disposed within the accumulation basin 150. The accumulation basin 150 collects the residual fluid carrying any unwanted debris (such as fecal material, dead skin cells, dirt, and other waste material), which flows into the removal line 140 by gravity and then flows on into the drain fitting 170 to enter the plumbing drain that leads to the sewer system.

An additional aspect of the invention, a buttocks spreader 180, is shown in FIGS. 6-9. The handheld personal hygiene perineal cleansing system 100 is designed to clean the perineum, the region of the body between the legs and buttocks that reaches from the pubic symphysis to the coccyx, and the surrounding physical structures. However, in some situations the user may not be able to readily access the portion of the perineum between the buttocks. This may be because of mobility issues, medical problems, or structural issues. In this situation, the buttocks spreader 180 may be advantageously used to first separate the buttocks and then introduce a cleansing spray from sprayer 160.

The buttocks spreader 180 attaches to the end of the spray arm 130. As seen in FIGS. 6-9, the buttocks spreader 180 comprises a leg squeeze mechanism 181, an articulation point 183, an optional membrane 182, and opposing convertible sides 185 above the articulation point that convert from shut to open. The buttocks spreader 180 is used with a sprayer 160 having an optional front ridge 156 and a spray head 169. Additionally, the buttocks spreader 180 is used with the accumulation basin 150. However, in this embodiment, the accumulation basin 150 is laterally expandable and contractible. As in the other embodiments, the expandable and contractible accumulation basin 150 comprises a basin outlet drain 158 configured to convey the fluid to the removal line 140.

The expandable and contractible basin 150 of the buttock's spreader 180, in contrast to the non-expandable accumulation basin 150 of the first embodiment, has convertible sides 185 having sufficient flexibility that they can be expanded from a narrower, relaxed state via actuation of a leg squeeze mechanism 181. The leg squeeze mechanism 181 includes two levers 186 that articulate at articulation point 183 via movement of the user's legs. When the bottom portions of the levers 186 are in the relaxed position and extend outwardly as in FIG. 8, the spreader basin 150 is closed, as in FIG. 6, with the sides 185 contracted. This reduced form factor allows the user to position the expandable and contractible accumulation basin 150 more easily. When the bottom portions of the levers are moved inwardly as the user manually squeezes the levers with the upper legs, the convertible side walls 185 of the basin 150 move outwardly to create a wider basin and to allow the sprayer 160 to be exposed, as in FIGS. 7-9.

In one aspect, the expandable and contractible basin 150 further comprises a flexible membrane 182 (FIG. 9) disposed at the front and back of the expandable basin side walls that is expanded as the side walls 185 are expanded.

To use the buttocks spreader 180, the user connects the mating portions of any quick release connectors that have been disconnected, such as for storage. Then the user places the spreader accumulation basin 150 that is closed with the sides contracted between the buttocks with the leg squeeze mechanism 181 extending downwardly from the spreader basin 150 along the upper legs. The user squeezes his/her legs together, which activates the expandable side walls 185 of the spreader basin 150 to open to expose the sprayer 160. The user then initiates the fluid flow into the sprayer 160 via the spray arm valve 132 or the safety lever 102. As in the embodiment with the non-expandable basin, the spreader basin 150 collects the residual fluid and debris, which is directed into the removal line 140 and on into the drain via the drain fitting 170.

In a third embodiment, shown in FIGS. 10-11, the handheld personal hygiene perineal cleansing system 100 is configured for use while the user is sitting on the toilet. This embodiment may be preferred by some users, or, in some instances, a user may not have the physical ability to stand in the shower or bath/shower combination to use the personal perineal cleansing system.

Although some toilets 175 may already be configured in a manner that allows usage of the personal perineal cleansing system, most toilets 175 are likely to require installation of a riser 190 to allow usage. In one aspect, the riser 190 comprises a generally U-shaped seat 191 having a front opening 193 and a riser attachment mechanism to secure the riser 190 to the top of the toilet 175.

The riser attachment mechanism may be one or more mechanical attachments 198 or may be a securing portion 199 of the riser. For example, mechanical attachments may be bolts that attach the back of the riser using the conventional holes 177 disposed at the back of the toilet rim. Or in another example, mechanical attachments 198 may be clamps that extend from the bottom of the riser 190 to engage the top portion of the toilet bowl.

The securing portion 199 of the riser also functions to secure the riser 190 to the top of the toilet 175. For example, the riser securing portion 199 may be positioned at the bottom portion of the riser and may take the form of an insert that extends downwardly from the riser into the toilet bowl.

When installed onto a toilet, the generally U-shaped seat 191 of the riser extends along both sides and the back of the toilet rim. The U-shaped seat 191 provides an increased vertical dimension, as compared to the toilet without the riser to facilitate use of the personal perineal cleansing system. The riser seat 191 comprises a top surface, a bottom surface, and side walls 191 that extend vertically from the seat top surface to the seat bottom surface. The side walls 191 include both inner side walls disposed in the interior of the U-shape and outer side walls disposed on the exterior of the U-shape. Disposed at the front of the riser walls 191 (at the peak of the arms of the U-shape, which is forward on the toilet) are rounded riser front walls 195 that define a riser front opening 193. The riser front opening 193 is sized and configured to allow insertion of the personal perineal cleansing system into the front of the riser 190. The riser front walls 195 preferably form a rounded front portion of the U-shape of the seat 191 portion of the riser 190.

In one optional aspect, side handles 197 may be included with the riser 190, which are preferably attachable and detachable from the riser, as needed. The inclusion of an option with side handles 197 may provide advantages to some users with disabilities or limitations, such as for use after back surgery to allow the user to ease into, and out of, a sitting position.

In a second optional aspect, as seen in FIG. 11, an inline water heater 122 is configured to warm or heat the water to be used. The inline water heater 122 may be warm the water through use of electric power, battery power, or mechanical power.

This third embodiment for use with a toilet 175, shares many similarities with the above-described embodiments. However, besides the difference in the usage of a riser 190, this embodiment differs in some aspects. The basin 150 may be designed with less vertical height to facilitate use. The angle of the curved portion 134 of the spray arm 130 may differ. And the basin 150 may be designed with a drain hole 149 instead of a removal supply line 140 and its accompanying components.

In this embodiment as in the embodiments above, the basin 150 is preferably oblong with rounded corners and with a smooth interior to facilitate cleaning. However, the basin 150 of this embodiment preferably has a reduced vertical height to facilitate insertion into the riser front opening 193. The basin 150 remains at least as tall as the sprayer 160, but the sprayer 160 may be inset lower into the bottom of the basin than in the earlier embodiments. Any of the types of sprayers 160 described above may be used.

Also, in contrast to the earlier embodiments, the basin 150 of this embodiment is not connected to a removal supply line 140, because the residual water and debris can drain directly into the toilet. In this case, the bottom of the basin 150 is configured with a drain hole 149 defined by drain hole edges 147. Drain hole 149 may merely be a hole cut into or molded into the bottom of the basin, may be a lined hole, may be a hole with an attached short tubular structure extending downwardly, or other opening providing access to the exterior of the basin.

The angle of the curved portion 134 of the spray arm 130 of this embodiment varies from the angle of the curved portion 134 of the spray arm 130 of the earlier embodiments, because the position of the user has changed from standing to sitting. Thus, in this embodiment, the angle of the curved portion 134 may be generally ninety-degrees. To use, the user grasps the handle 133 and pulls the basin holding the sprayer 160 toward the user.

In this embodiment of FIGS. 10-11, some elements may need to be adapted to attach to the available water supply pipe, with the selection of the water supply to be used based on factors such as bathroom layout, distances, water line availability, and aesthetics. For example, if the sink is near the toilet and the water line is available, the water-ingress fitting 110 may be connect to the water line under or near the sink, and the flexible feeder supply line 120 may be longer than in the earlier embodiments used in a shower or shower/bath. The supply line 120 may be run directly from under or near the sink, may extend through a hole in a cabinet supporting the sink, or may be installed in a manner appropriate for the bathroom layout, distances, and aesthetics. However, if the shower/bath combination is near the toilet, the personal perineal cleansing system may be attached to the showerhead 105, as described above. Or, as may be appropriate in a different layout, the water-ingress fitting 110 may be connected to the water piping behind the toilet 175 or under the toilet tank.

The handheld personal hygiene perineal cleansing system 100 may further include a hand plunger that attaches to or near the removal line outlet 148. The optional hand plunger is configured to allow a user with limited mobility to attach the removal line outlet 148 to the drain inlet 171 without bending over.

Figure 12:
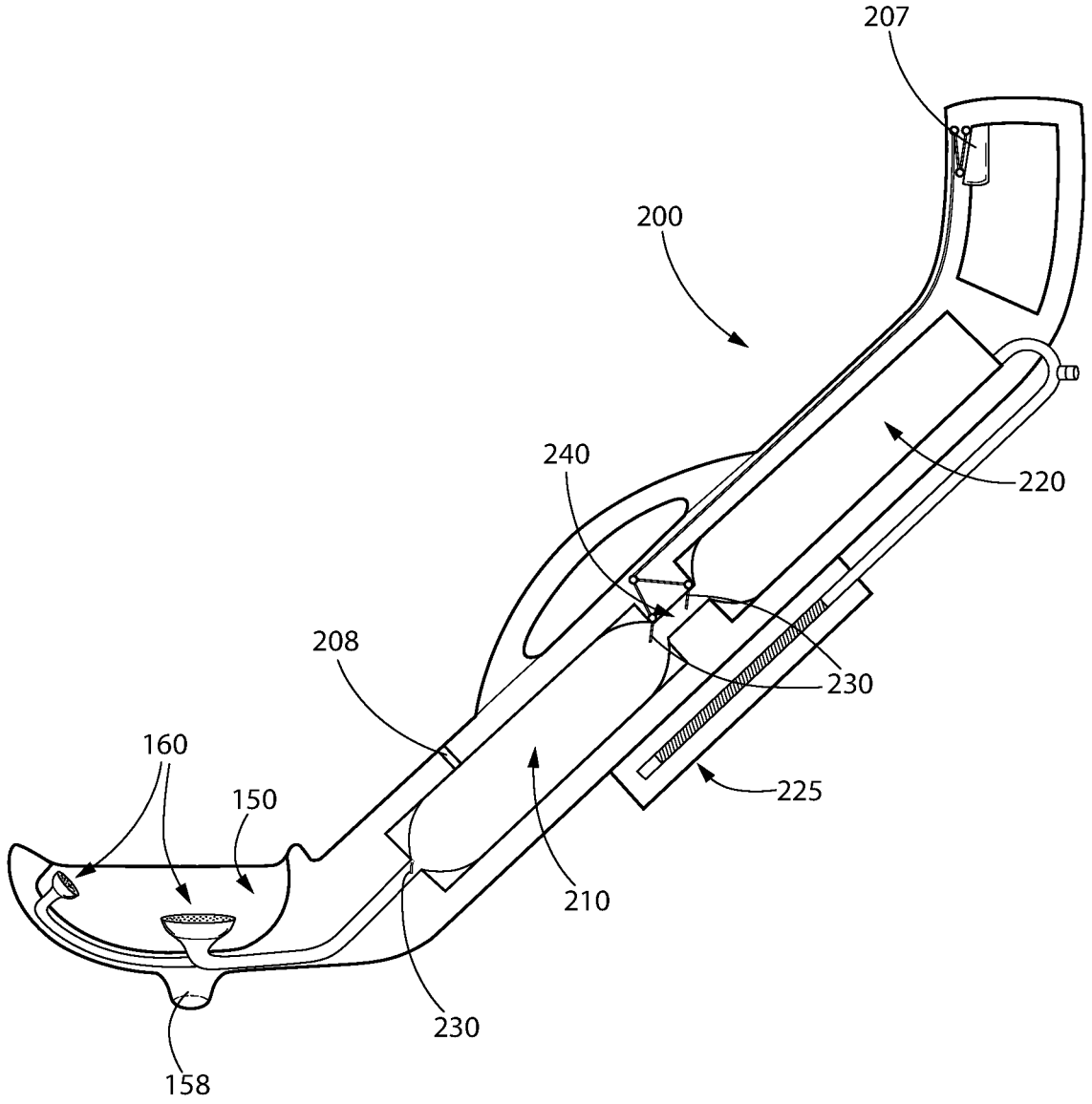
FIG. 12 is a cutaway view showing portions of the self-contained, portable handheld device in a fourth embodiment of the invention.
Figure 13:
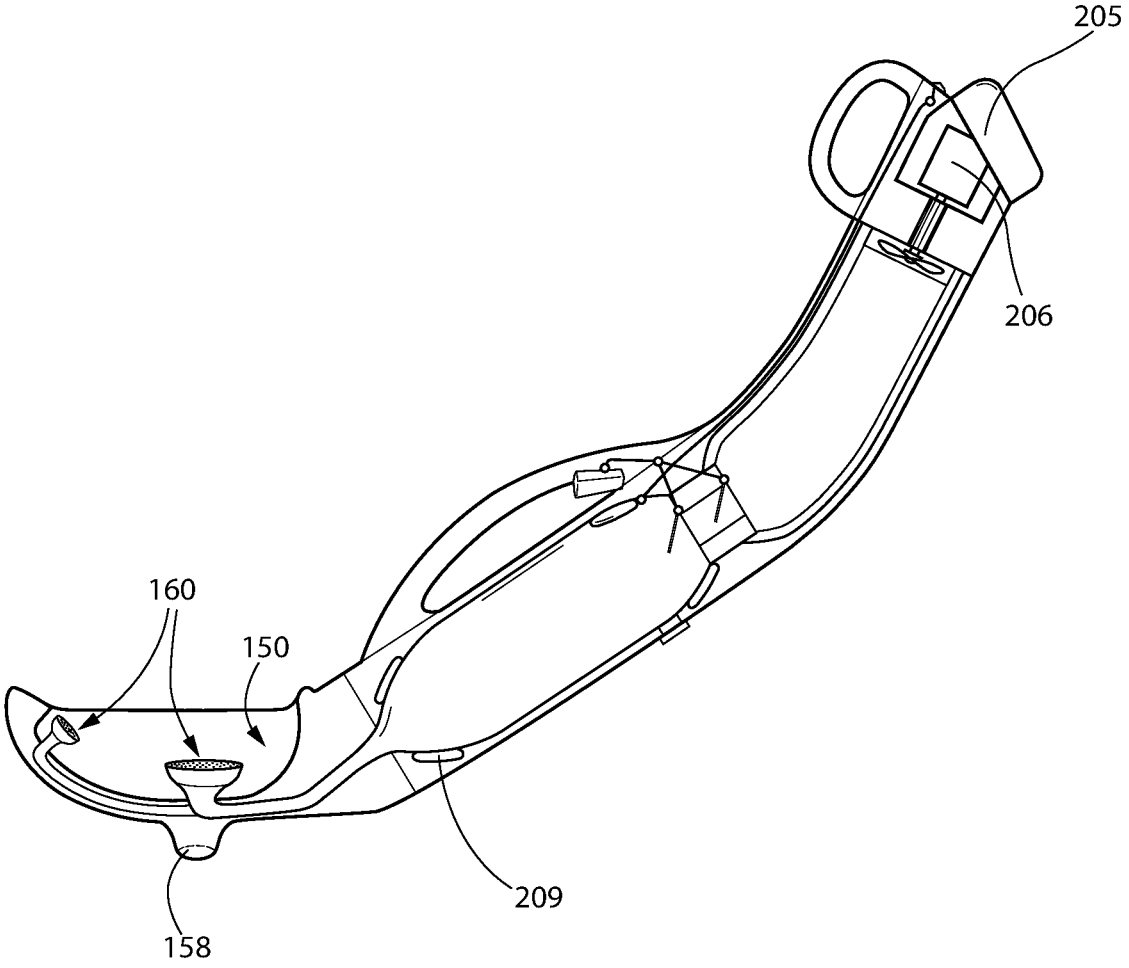
FIG. 13 is a cutaway view showing portions of the self-contained, portable handheld device in a fourth embodiment of the invention.

FIGS. 12-13 show a fourth embodiment, which is a portable, battery powered, forced air handheld personal hygiene device 200 that is suitable for use when a water line connection is not available, such as for camping or for long-haul trucking. A battery 205 (preferably rechargeable) supplies power to a motor 206 which is activated via a trigger valve release 207. An air pump handle 225 is connected to a pressurized air tank 220 (preferably with a sealed fan encasement) which is, in turn, connected to a water tank 210 via a PSI air pressure regulator 240. Valves 230 are disposed between the air chamber/tank 220 and the water tank 210 and are disposed between the water tank 210 and the sprayer system 160. In a preferred aspect, a battery-powered or mechanically powered water heating element 208 supplies heat to the water within the water tank 210 for comfort.

Figure 14:
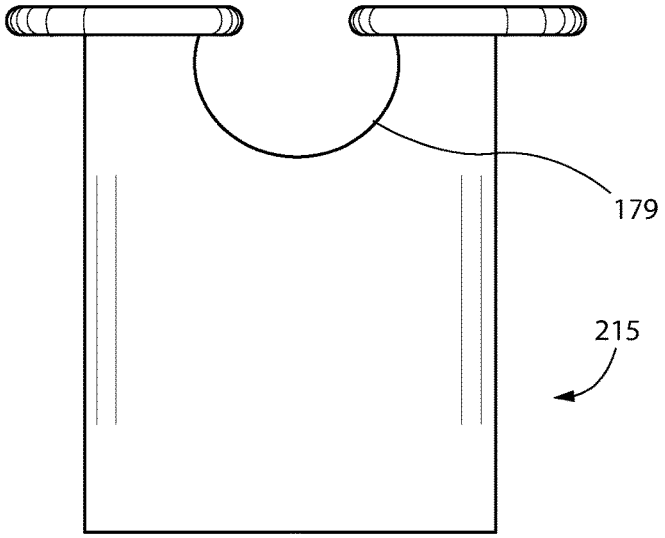
FIG. 14 is a front view of a portable toileting bowl or bucket for use with the portable self-contained handheld device of the fourth embodiment of the invention.
Figure 15:
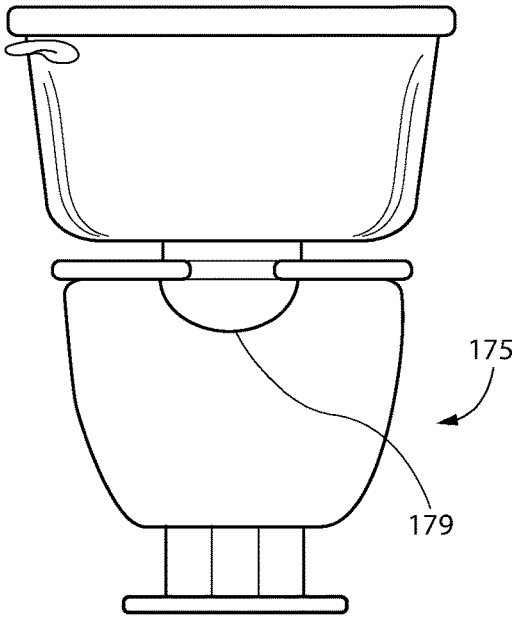
FIG. 15 is a front view of a modified toilet bowl for use with the handheld device of the third or fourth embodiment of the invention.
Figure 16:
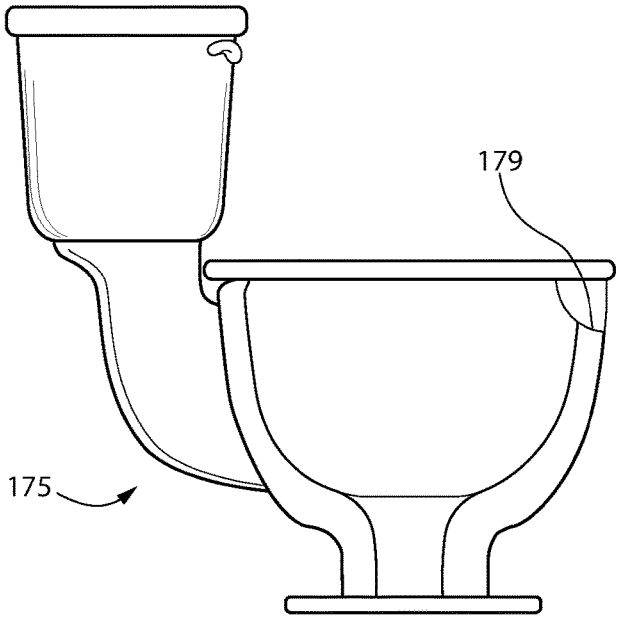
FIG. 16 is a side view of a modified toilet bowl for use with the portable self-contained handheld device of the third or fourth embodiment of the invention.
Figure 17:
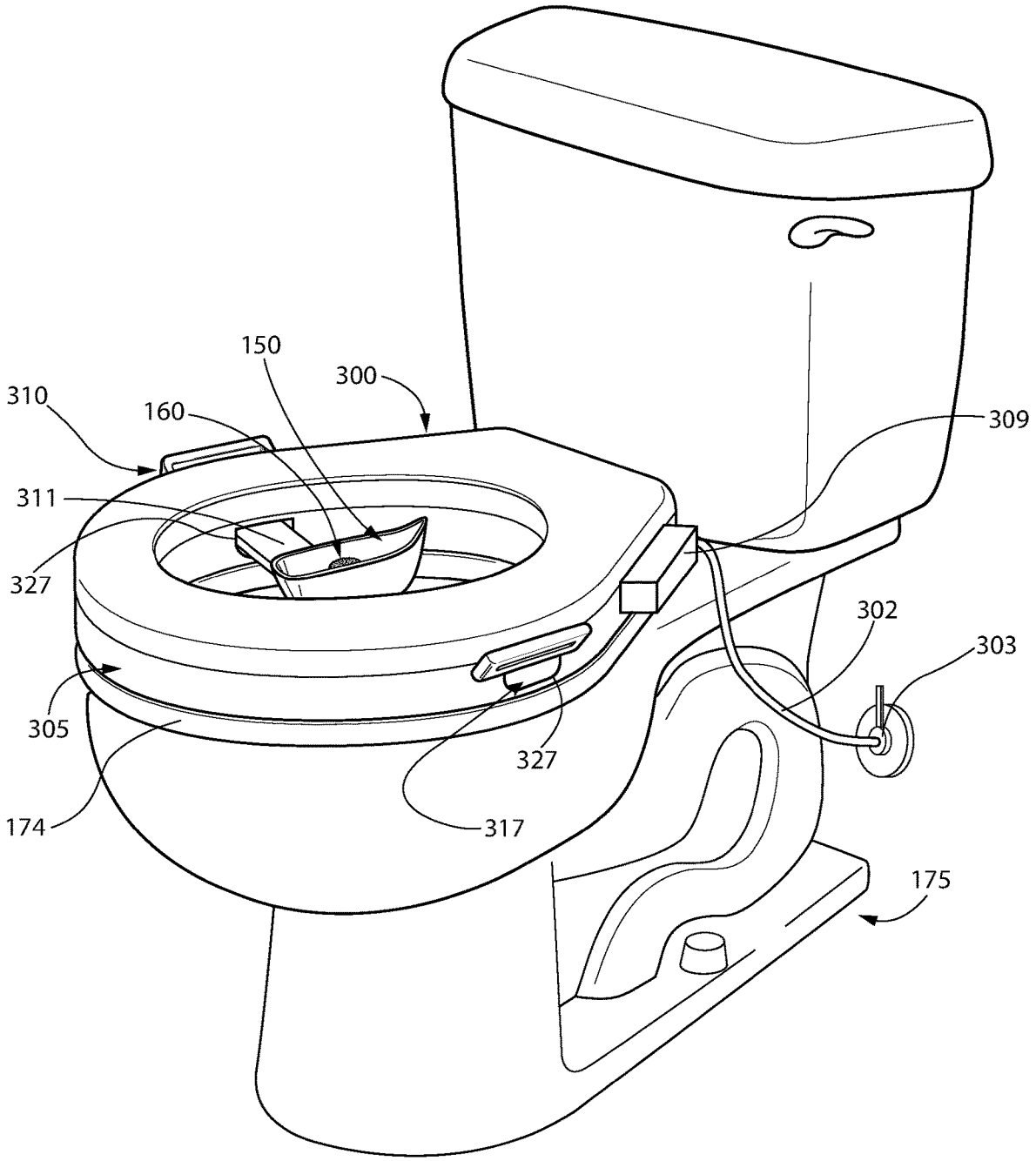
FIG. 17 is a perspective view of a standard toilet bowl with an attached secondary seat incorporating a basin bidet of the fifth embodiment of the invention.
Figure 18:
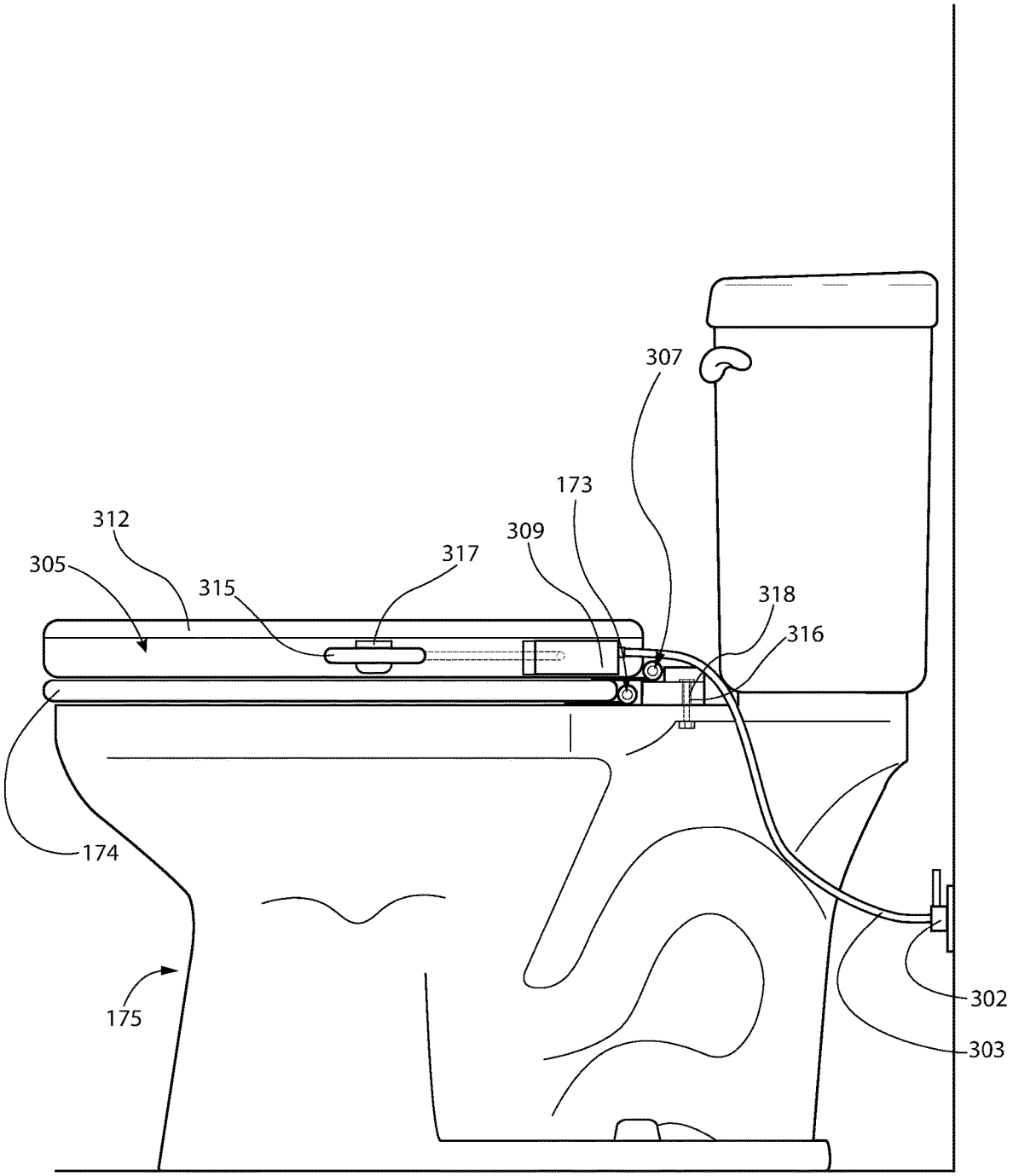
FIG. 18 is a side view of a standard toilet bowl with a lowered primary and secondary seat, with the secondary seat incorporating a basin bidet of the fifth embodiment of the invention.

This fourth embodiment may be used with the riser (described above) on a standard toilet, with a portable receptacle 215 (FIG. 14) with a center front opening 179, or with a specialized toilet with a center front opening 179 (FIGS. 15-16).

The fifth embodiment of FIGS. 17-22 is a basin bidet 300 that is incorporated into a secondary toilet seat 305, which is installed above the primary toilet seat 174. The basin bidet 300 is an add-on to a standard toilet 175. The primary toilet seat 174 remains usable, but when cleansing is desired, the secondary toilet seat 305 can be folded downwardly (to a horizontal orientation) to rest on the primary toilet seat 174, whereby a cleansing water spray can be provided. In a preferred aspect, the primary and secondary seat are sold as a unit to facilitate interoperability.

The basin bidet 300 includes the basin 150 (generally described above) with one or more internal sprayers 160 (generally described above) disposed within the basin 150. The basin 150 comprises an open top, bowl that is sized and configured to accommodate the sprayer assembly 160. The bottom portion of the basin 150 is configured with a drain hole 149 defined by drain hole edges 147. In the basin bidet embodiment 300, the basin 150 is suspended (via basin support 320) in the middle of the toilet bowl (when the secondary seat 305 is folded down) with the drain hole 149 positioned generally in the middle of the toilet bowl to allow drainage of used water and any carried residual material to drain into the toilet bowl. In one aspect of the invention, the basin 150 is removable and replaceable with a second basin 150, such as may be desired when the cleansing system 100 of the present invention is used by multiple members of one household. In this aspect, a basin quick connect 304 (FIG. 21) is disposed between the basin 150 and the basin support 320.

The basin 150 is raised and lowered by a handle assembly 310. The handle assembly includes a right and left grip 315, a right and left handle stem 311, a right pivot mechanism 319, and a left pivot mechanism 319. The right grip 315 is attached to the right handle stem 311, generally at or near the distal end of the stem 311. The left grip 315 is attached to the left handle stem 311, generally at or near the distal end of the stem 311. The grips 315 are positioned beyond the outer edges of the secondary toilet seat 305 so as to be reachable by the user.

The proximal end of the right handle stem is rotatably attached to a right side of a centrally disposed basin support 320 at stem-to-basin support hinge 313. The proximal end of the left handle stem is rotatably attached to a left side of the centrally disposed basin support 320 at stem-to-basin support hinge 313. The basin 150 is attached to the basin support 320. Preferably the basin 150 is fixedly attached to the basin support 320, but in another aspect of the invention the basin support 320 is rotatably attached to the basin support 320 to allow the basin to rotate up to 30 degrees forward or backward to allow a more personalized fit of the basin against the body of the user.

A distal portion of each of the handle stems 311 is pivotally attached to the secondary toilet set 305. The secondary toilet seat 305 includes right and left vertical slots 317 (defined by right and left slot edges 327) comprising openings in the right and left sides of the secondary toilet seat 305. The slots 317 are wide enough to accommodate the width of the distal portion of the handle stem 311 and are tall enough to accommodate the vertical movement of the distal portion of the handle stem 311 as it pivots upward and downward. A pivoting sleeve or other pivot mechanism 319 (FIG. 21) may be used at this pivot point. A distal portion of the right handle stem 311 is accommodated by the right slot with a right pivot mechanism pivotally attaching the distal portion of the right handle stem to the secondary toilet seat within the right slot. A distal portion of the left handle stem is accommodated by the left slot with a left pivot mechanism pivotally attaching the distal portion of the left handle stem to the secondary toilet seat within the left slot.

In an aspect of the invention, the right and left slots 317 also extend horizontally at least forwardly or backwardly. This allows forward and backward adjustment of the basin 150. The horizontal extension is disposed within the secondary toilet seat 305. In this aspect, the water line 302 has sufficient length to allow the forward and backward movement of the basin 150. The forward and backward adjustment allows the user to position the basin 150 in a more precise manner to accommodate various body sizes and shapes.

A water line 302 (with at least one fluid flow passage therethrough) is connected to a household water supply pipe at shutoff valve 303. The water line 302 extends from the shutoff valve 303 to a spray head 169 within the basin 150. It is sufficiently long enough to run from the shutoff valve 303 to the secondary toilet seat 305, to preferably run within the interior of the secondary toilet seat 305, to preferably run within one of the left or right handle stems 311, and then to attach to the spray head 169 within the sprayer system 160 to provide water for cleansing. The water line 302 is preferably configured similarly to the flexible feeder supply line 120 described above. Preferably the user can access a switch 301 to activate the flow of water from the water line 302 to the spray head 169. In another aspect of the invention, the switch 301 also controls the volume of water flow. In this aspect, the user is able to select a higher spray flow, or a lower spray flow, based on his or her preferences.

For the comfort of the user, preferably the secondary toilet seat has an upper layer of cushion 312, such as foam, gel, gel cellular material, or other soft cushiony material. Also, to add comfort to the user, a water heating device 309 is preferably included. The water heater 309 heats the water in the water line 302 or in a small reservoir within or near the water line 302. The water heater 309 is installed beside the water line 302 or may be an inline heater. The water heater 309 may be battery powered, mechanically powered, or electrically powered.

Figure 19:
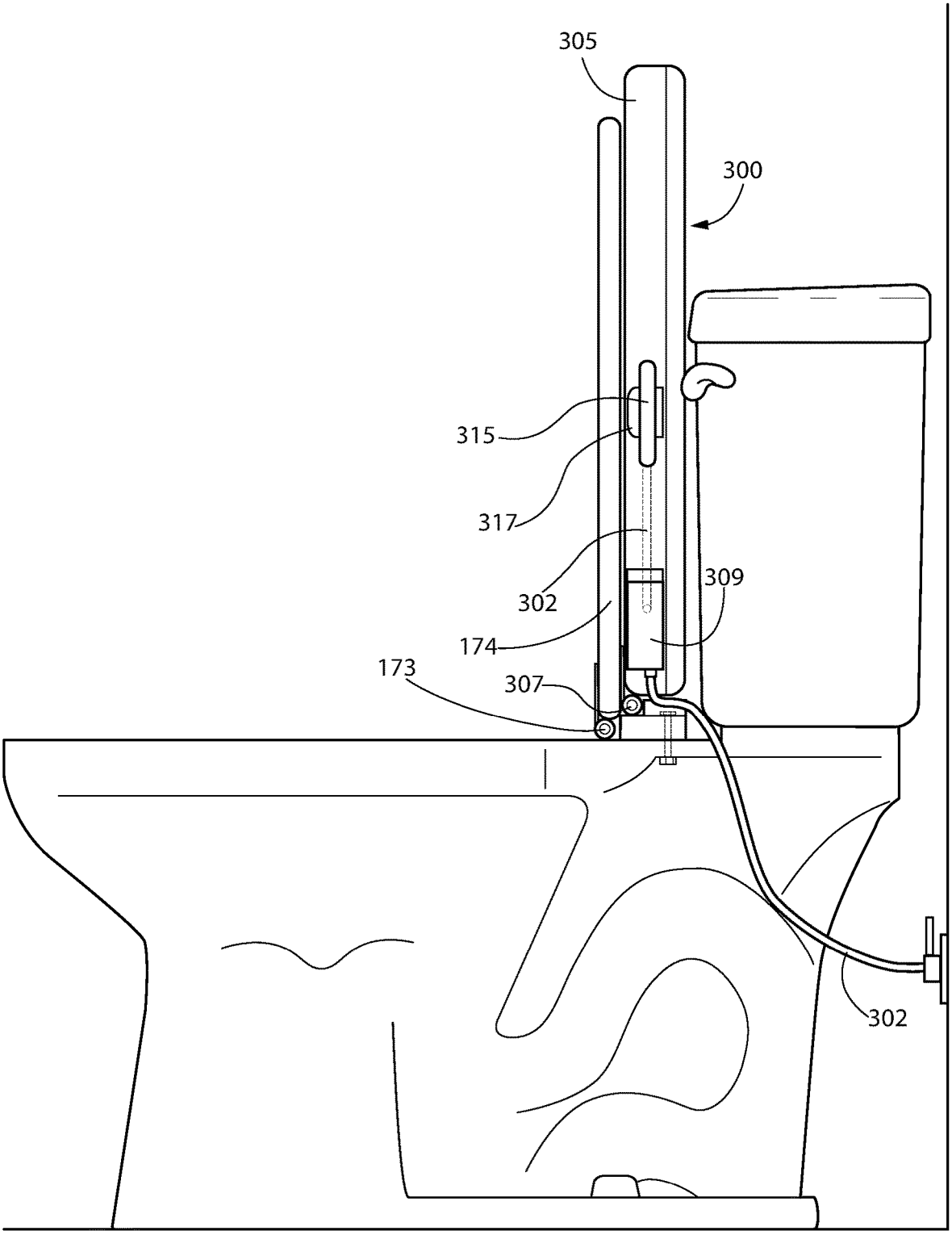
FIG. 19 is a side view of a standard toilet bowl with a raised standard toilet seat and a raised secondary seat that incorporates a basin bidet of the fifth embodiment of the invention.
Figure 20:
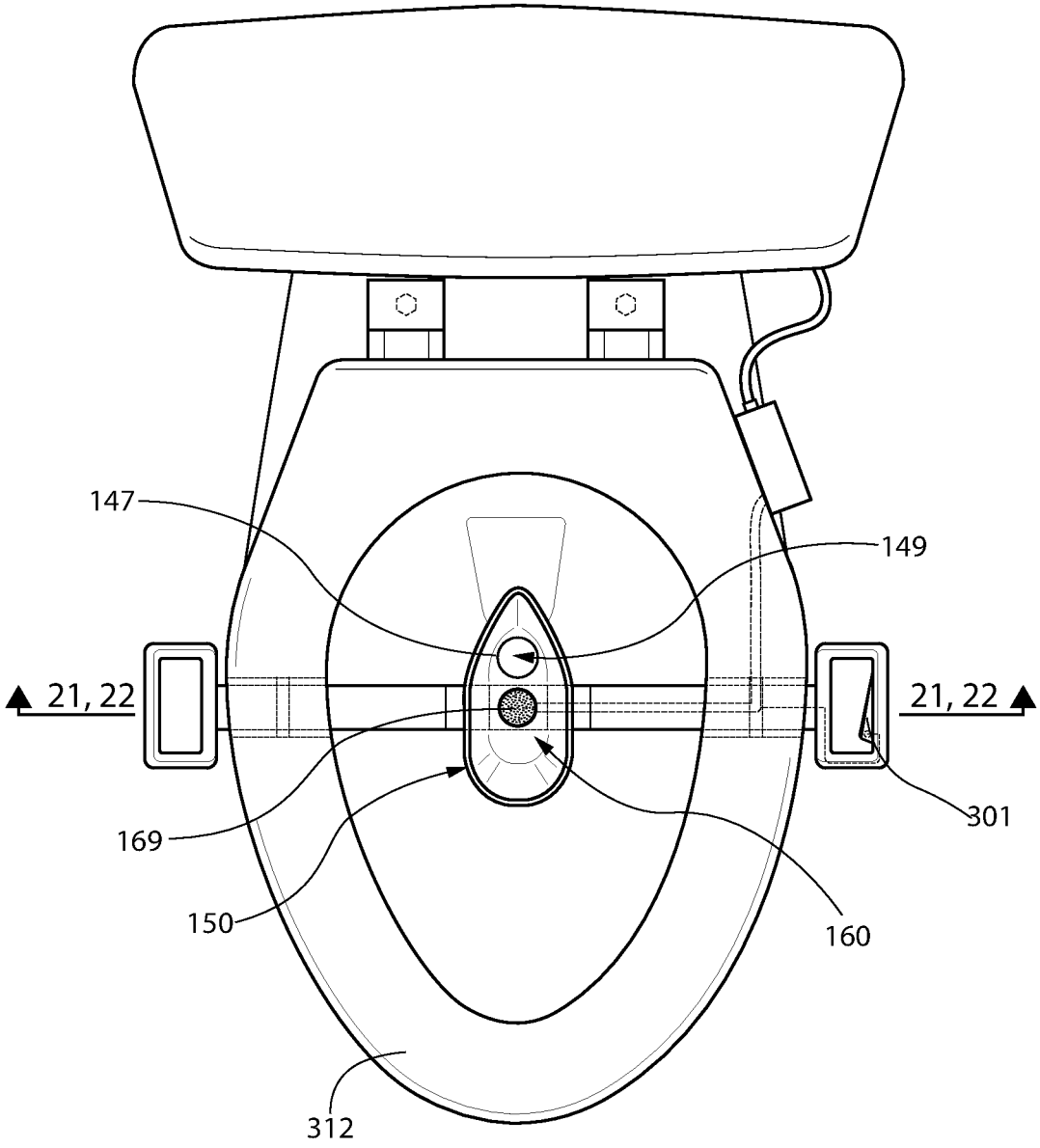
FIG. 20 is a top view of a standard toilet bowl with a secondary seat incorporating the basin-bidet of the fifth embodiment of the invention.
Figure 21:
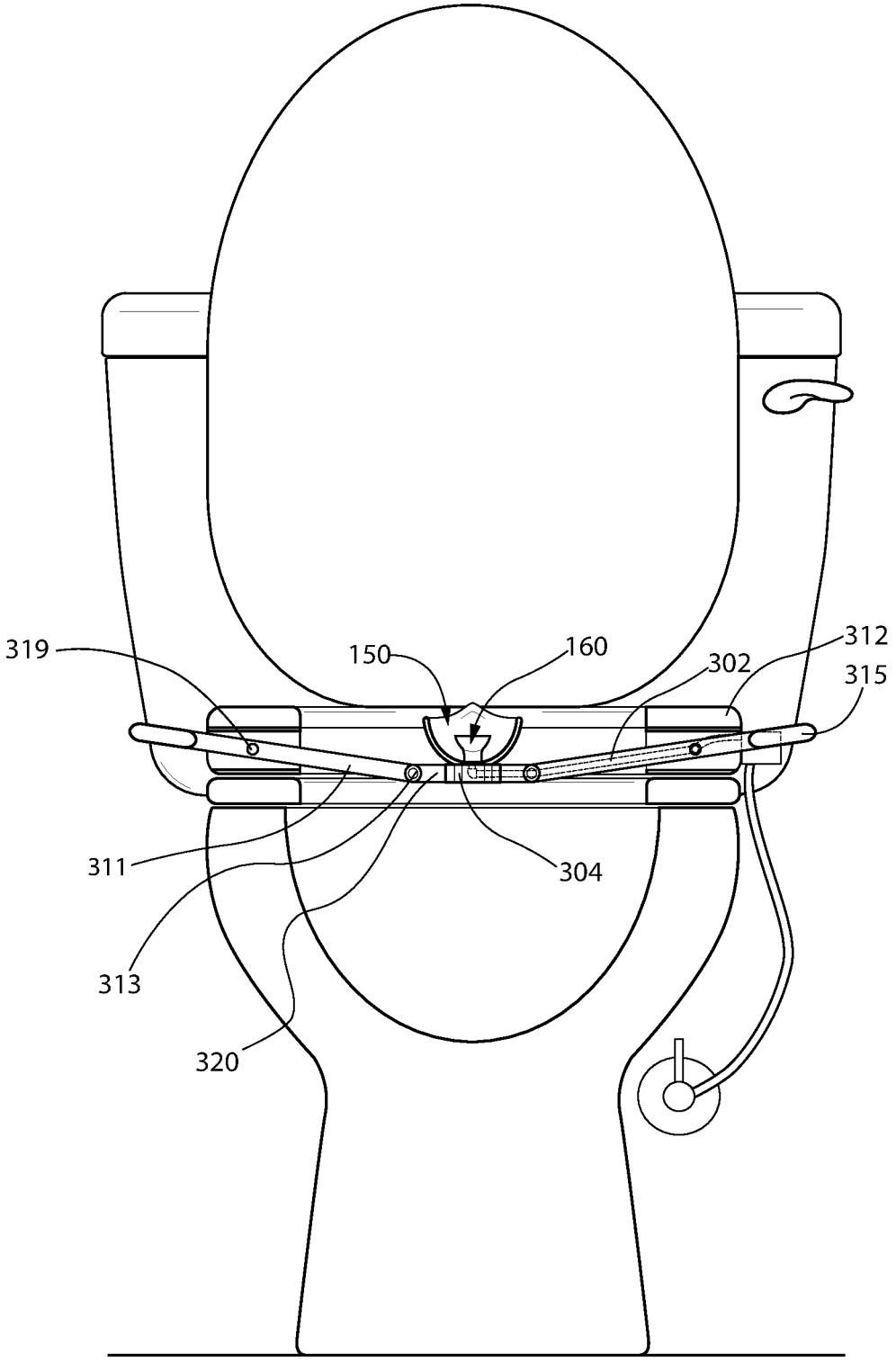
FIG. 21 is a front view taken from view line 21, 22 of FIG. 20 of a standard toilet bowl with a lowered secondary seat of the invention showing the incorporated basin in the downward, unextended position.
Figure 22:
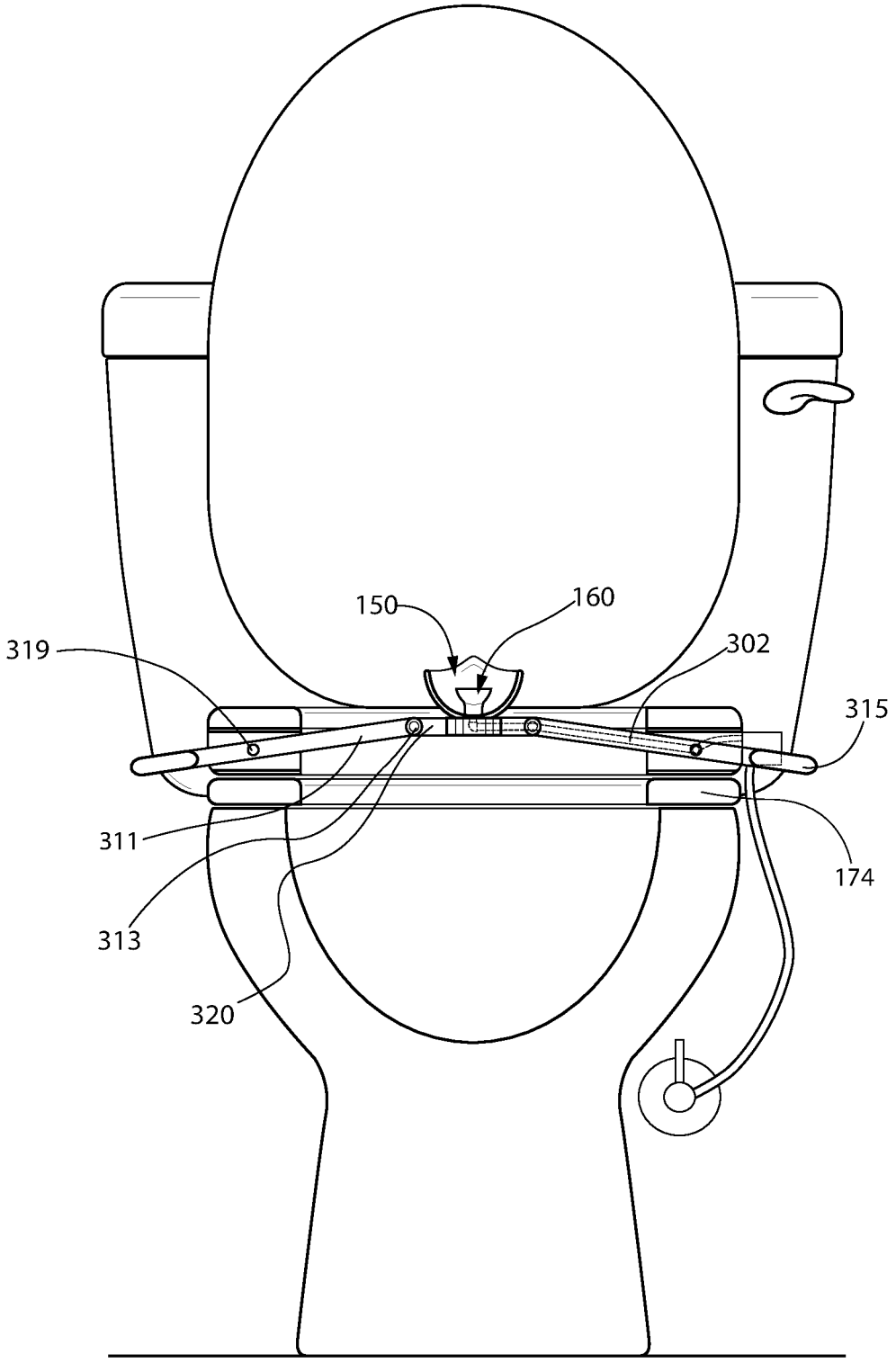
FIG. 22 is a front view taken from view line 21, 22 of FIG. 20 of a standard toilet bowl with a lowered secondary seat of the invention showing the incorporated basin in the upward, extended, body-engaging position.

Before use, the basin bidet system 300 may be arranged as shown in FIG. 19 with both the primary toilet seat 174 and the secondary toilet seat 305 in a rotated upwardly, vertical orientation. To use the basin bidet system 300, the user first lowers the primary toilet seat 174 (which rotates at primary rear hinge 173 to a horizontal orientation) and may first sit on the primary toilet seat 174 to use the toilet as usual. If the user wants to take advantage of the additional cleansing provided by the basin bidet system 300, the user stands up and folds the secondary seat 305 downward (rotating at rear hinge 307 to achieve a horizontal orientation) with the secondary seat 305 then resting on, and adjacent to, the primary seat 174. In this position, the grips 315 are positioned angled toward the top of the slot 317 with the basin lowered in the middle of the toilet bowl, as seen in FIG. 21. The user sits on the secondary seat 305 and engages the grips 315 with his/her hands to push downwardly, which causes the grips 315 to move downwardly and the distal portion of the handle stem 311 to pivot at pivot mechanism 319, which brings the proximal portion of the right and left handle stems 311 upward. This causes rotation at both the right stem-to-support hinge 313 and the left stem-to-support hinge 313, which raises the basin support 320 that is suspended between the two stem-to-basin hinges 313. Raising the basin support 320 in turn raises and elevates the attached basin 150. The basin 150 can be elevated to or above the level of the top of the secondary seat 305.

To achieve a desirable fit, the user controls the amount of upward motion of the basin 150 by the amount of force applied to the grips 315. Most users will raise the basin 150 to make a relatively tight seal with the perineal area and buttocks to allow for effective cleaning along with containment of the water sprayed plus any dirt, bacteria, or fecal residual material. In the aspect in which the right and left slots 317 have a horizontal extension, the user also can move the handle grips 315 slightly forward or backward to attain a comfortable fit.

After the preferred fit is achieved, the user triggers a switch 301 to allow the water to travel from the water line 302 to spray out of the spray head 169 of the spray assembly 160. The water cleanses the area of the body to which it is directed, and thereby rinses away any urine or fecal material. When the hand grips 315 are released, the basin 150 sinks downward (either by the force of gravity, or in some aspects by encouragement of a spring). The residual rinse water and carried material then drains from the interior of the basin 150 by gravity though the basin outlet drain hole 49 and drains into the toilet bowl. The secondary seat 305 may be left in the folded down, horizontal position to continue draining for a few seconds to a few minutes, if desired. Then both the primary and secondary seat may be folded upward into the position shown in FIG. 19, if desired.

Preferably the primary toilet seat 174 and the secondary toilet seat 305 are manufactured and sold as a unit to promote full functionality and interoperability. However, the secondary toilet seat 305 can optionally be sold as an add-on to a conventional primary toilet seat 174.

The personal perineal cleansing basin bidet of the fifth embodiment is easy to install. The water line 302 is connected to a convenient household water line, such as at a shutoff valve 303. A tee may be inserted at the shutoff valve 303 if needed to accommodate a separate water intake for the toilet 175. The combination primary and secondary toilet seat unit has a rear portion with a channel 316 aligned with the channel at the rear of the toilet bowl, which is typically used for receiving a screw or pin 318 to hold the toilet seat onto a ceramic toilet bowl. A longer pin 318 may be included in the installation kit, if needed. The pin 318 is inserted through the toilet channel and through the combination primary and secondary seat unit channel 316 and secured by a securing nut.

In any of the embodiments, one or more gaskets (such as gasket 162 in FIG. 4) may be used to achieve a tight seal at any connection or at all the connections.

The cleansing system 100 of the present invention is specifically designed to efficiently clean the perineal area. It provides advantages to those with limited mobility, but also to all others who want to clean the perineal area. Use of the system not only cleanses the skin, it also does so without the residual wastewater or any fecal residue touching the floor of the bathtub or shower. Further, no alternations to the household plumbing are required, no reconstruction of the bathroom is needed, and it does not require additional floor space to install, as would a conventional separate bidet. The cleansing system 100 also provides ecological savings. Use of the invention reduces or eliminates the need for toilet paper, which in turn reduces or eliminates the need to harvest trees for production of toilet paper. (Tens of thousands of trees are cut down every day for this use.) Additionally, the inventive cleansing system provides advantages in septic tank maintenance and in municipal sewage treatment, which are also due to the reduction or elimination of toilet paper usage.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A personal perineal cleansing system for use with a toilet comprising:

a secondary toilet seat hingedly connectable to said toilet; said secondary toilet seat having a right slot defined by right slot edges and a left slot defined by left slot edges; wherein said right slot edges define an opening in a right side of said secondary toilet seat; and wherein said left slot edges define an opening in a left side of said secondary toilet seat;

a handle assembly comprising a right grip attached to a right handle stem, a left grip attached to a left handle stem, a right pivot mechanism pivotally attaching said right handle stem to said secondary toilet seat, a left pivot mechanism pivotally attaching said left handle stem to said secondary toilet seat; wherein said right handle stem is accommodated by said right slot; wherein said left handle stem is accommodated by said left slot;

a basin support rotatably connected to a proximal end of said right handle stem and rotatably connected to a proximal end of said left handle stem;

a basin connected to said basin support; said basin comprising an open-top bowl and a basin drain hole defined by drain hole edges;

a sprayer disposed within an interior of said basin; said sprayer comprising a spray head; and a water line with at least one fluid flow passage therethrough, wherein said water line is configured to connect to and convey fluid from a water supply pipe to said spray head.

2. The personal perineal cleansing system as recited in claim 1, wherein said right handle stem is pivotally attached to said secondary toilet seat within said right slot; and wherein said left handle stem is pivotally attached to said secondary toilet seat within said left slot.

3. The personal perineal cleansing system as recited in claim 1, wherein said personal perineal cleansing system further comprises a water heater for warming said fluid.

4. The personal perineal cleansing system as recited in claim 1, wherein said spray head comprises nozzles directed upwardly for spraying the perineal area.

5. The personal perineal cleansing system as recited in claim 4, wherein said spray head further comprises nozzles directed outwardly for spraying the interior of said basin.

6. The personal perineal cleansing system as recited in claim 1, further comprising a switch configured to activate a flow of said fluid from said water line to spray out of said spray head.

7. The personal perineal cleansing system as recited in claim 6, wherein said switch regulates the volume of flow of said fluid.

8. The personal perineal cleansing system as recited in claim 1, further comprising a primary toilet seat hingedly connectable to said toilet; wherein said primary toilet seat and said secondary toilet seat are independently rotatable.

9. The personal perineal cleansing system as recited in claim 1, wherein said primary toilet seat and said secondary toilet seat are integrated into a primary-secondary seat unit.

10. The personal perineal cleansing system as recited in claim 1, further comprising a basin quick connect disposed between said basin and said basin support.

11. A method of use of a cleansing system for cleansing a perineal area, comprising:

sitting on a primary toilet seat rotatably attached to a toilet, which is in a horizontal orientation;

folding a secondary toilet seat, which is rotatably attached to said toilet, downward into a horizontal orientation;

sitting on said secondary toilet seat;

grasping a right grip with a right hand, wherein said right grip is attached to a distal end of a right handle stem;

grasping a left grip with a left hand, wherein said left grip is attached to a distal end of a left handle stem;

pushing downwardly on said right grip and said left grip; wherein said pushing downwardly causes a proximal portion of said right handle stem to pivot upwardly, and which causes a proximal portion of said left handle stem to pivot upwardly; wherein said pivoting upwardly of said proximal portion of said right handle stem and said pivoting upwardly of said proximal portion of said left handle stem causes a basin support to be moved vertically upward; wherein said moving vertically upward of said basin support causes a basin to be moved vertically upwardly; and activating water flow from a sprayer disposed within said basin to spray water onto said perineal area.

12. The method of use of a cleansing system for cleansing a perineal area, as recited in claim 11, wherein said basin is positioned adjacent to said perineal area.

13. The method of use of a cleansing system for cleansing a perineal area, as recited in claim 11, further comprising:

allowing said water to drain into a bowl of said toilet through a basin drain hole defined by drain hole edges.

14. The method of use of a cleansing system for cleansing a perineal area, as recited in claim 11, further comprising:

disconnecting said basin from said basin support.

15. The method of use of a cleansing system for cleansing a perineal area, as recited in claim 11, wherein:

said proximal portion of said right handle stem pivots within a right slot defined by right slot edges, which is disposed within a right side of said secondary toilet seat; and said proximal portion of said left handle stem pivots within a left slot defined by left slot edges, which is disposed within a left side of said secondary toilet seat.

16. The method of use of a cleansing system for cleansing a perineal area, as recited in claim 11, wherein said water sprayed onto said perineal area is heated water.

17. The method of use of a cleansing system for cleansing a perineal area, as recited in claim 11, wherein said activating water flow comprises:

activating a switch.

18. The method of use of a cleansing system for cleansing a perineal area, as recited in claim 11, further comprising:

adjusting a volume of said water flow.

19. The method of use of a cleansing system for cleansing a perineal area, as recited in claim 11, further comprising:

rotating said primary toilet seat upward so that said primary toilet seat is in a vertical orientation; and rotating said secondary toilet seat upward so that said secondary toilet seat is in a vertical orientation.

20. A personal perineal cleansing system for use with a toilet comprising:

a secondary toilet seat connectable at a rear hinge to said toilet; said secondary toilet seat having a right slot opening in a right side of said secondary toilet seat, said right slot opening defined by right slot edges; said secondary toilet seat having a left slot opening in a left side of said secondary toilet seat, said left slot opening defined by left slot edges;

a handle assembly comprising a right handle stem extending through said right slot opening, a right grip attached to a distal end of said right handle stem, a right pivot mechanism disposed within said right slot opening, a left handle stem extending through said left slot opening, a left grip attached to a distal end of said left handle stem, and a left pivot mechanism disposed within said left slot opening;

a basin support rotatably connected to a proximal end of said right handle stem and rotatably connected to a proximal end of said left handle stem;

a basin connected to said basin support; said basin comprising an open-top bowl and a basin drain hole defined by drain hole edges;

a sprayer disposed within an interior of said basin; and a water line with at least one fluid flow passage therethrough, wherein said water line is configured to connect to and convey fluid from a water supply pipe to said sprayer.

* * * * *